US011453997B2

(12) United States Patent
Ohiwa et al.

(10) Patent No.: US 11,453,997 B2
(45) Date of Patent: Sep. 27, 2022

(54) WORK MACHINE AND METHOD FOR CONTROLLING THE SAME

(71) Applicant: KOMATSU LTD., Tokyo (JP)

(72) Inventors: Kenji Ohiwa, Tokyo (JP); Tomohiro Nakagawa, Tokyo (JP); Ryuji Kanda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 357 days.

(21) Appl. No.: 16/652,820

(22) PCT Filed: Jan. 22, 2019

(86) PCT No.: PCT/JP2019/001778

§ 371 (c)(1),
(2) Date: Apr. 1, 2020

(87) PCT Pub. No.: WO2019/146570

PCT Pub. Date: Aug. 1, 2019

(65) Prior Publication Data

US 2020/0232181 A1 Jul. 23, 2020

(30) Foreign Application Priority Data

Jan. 26, 2018 (JP) ..... JP2018-011606

(51) Int. Cl.
*E02F 3/96* (2006.01)
*E02F 9/26* (2006.01)
*E02F 9/22* (2006.01)

(52) U.S. Cl.
CPC ..... *E02F 3/966* (2013.01); *E02F 3/963* (2013.01); *E02F 9/2228* (2013.01); *E02F 9/265* (2013.01)

(58) Field of Classification Search
CPC ..... E02F 3/963; E02F 3/966; E02F 9/2033; E02F 9/2214; E02F 9/2228; E02F 9/24; E02F 9/265
See application file for complete search history.

(56) References Cited

U.S. PATENT DOCUMENTS 5,174,387 A * 12/1992 Arndt ..... E02F 3/966 91/321
6,510,902 B1 * 1/2003 Prokop ..... E02F 3/966 173/1
8,704,507 B2 * 4/2014 Oksman ..... B25D 9/00 173/90
9,309,649 B2 * 4/2016 Nishikawa ..... E02F 9/2285
(Continued)

FOREIGN PATENT DOCUMENTS

CN 104619920 A 5/2015
CN 104204474 B 8/2017
(Continued)

*Primary Examiner* — Tyler J Lee
(74) *Attorney, Agent, or Firm* — Faegre Drinker Biddle & Reath LLP

(57) ABSTRACT

A work implement includes a breaker. Sensors detect an attitude of the work implement. A pilot valve controls the operation of the breaker. A controller controls the pilot valve. The controller detects, from the attitude of the work implement obtained by the sensors, a distance between a tip of the breaker and a striking limit. When it is determined that the tip of the breaker has reached the striking limit, the controller controls the pilot valve to stop the operation of the breaker.

10 Claims, 14 Drawing Sheets

(56) References Cited

U.S. PATENT DOCUMENTS

| | | | | |
|---|---|---|---|---|
| 10,179,424 | B2 * | 1/2019 | Ellis | E02F 3/966 |
| 10,620,036 | B2 * | 4/2020 | Yamada | G01L 19/06 |
| 10,857,658 | B2 * | 12/2020 | Joo | B25D 9/26 |
| 11,144,808 | B2 * | 10/2021 | Koekemoer | E02F 3/966 |
| 2012/0250815 | A1 * | 10/2012 | Oksman | E02F 3/966 377/16 |
| 2014/0060932 | A1 * | 3/2014 | Connell | E21B 7/022 175/40 |
| 2015/0081165 | A1 | 3/2015 | Yamashita et al. | |
| 2016/0258135 | A1 | 9/2016 | Shimano et al. | |
| 2017/0120478 | A1 | 5/2017 | Ellis et al. | |

FOREIGN PATENT DOCUMENTS

| | | | |
|---|---|---|---|
| JP | S60-22284 | U | 2/1985 |
| JP | 2003-049453 | A | 2/2003 |
| JP | 2003-269066 | A | 9/2003 |
| JP | 3782337 | B2 | 6/2006 |
| JP | 2011-58281 | A | 3/2011 |
| JP | 2017-52021 | A | 3/2017 |
| JP | 2018-1282 | A | 1/2018 |

* cited by examiner (A)

(B)

(C)

WORK MACHINE AND METHOD FOR CONTROLLING THE SAME

TECHNICAL FIELD

The present invention relates to a work machine and a method for controlling the work machine, and more particularly, relates to a work machine equipped with a breaker and a method for controlling the work machine.

BACKGROUND ART

A work machine equipped with a breaker is disclosed in, for example, Japanese Patent Laying-Open No. 2003-49453 (PTL 1). The breaker includes a chisel disposed at the tip as a tool and a piston that strikes the chisel.

In crushing a land area with the breaker, while the tip of the chisel is being pressed against the land area to be crushed, the chisel is struck by the piston, and accordingly, a striking force is applied by the piston to the chisel so as to crush the land area.

CITATION LIST

Patent Literature

PTL 1: Japanese Patent Laying-Open No. 2003-49453

SUMMARY OF INVENTION

Technical Problem

If the chisel is struck by the piston when no load is applied to the tip of the chisel, a so-called blank striking occurs. In order to prevent the blank striking from being applied as a load to the breaker, the blank striking is prohibited.

In order to prevent the blank striking from occurring during the crushing operation of the breaker, after the land area is crushed, the striking by the breaker is stopped at the operator's discretion. However, due to a time lag between a time when the land area is crushed and a time when the crushing operation is actually stopped, even a skilled operator may not prevent the blank striking from occurring.

An object of the present disclosure is to provide a work machine capable of preventing any blank striking from occurring so as to reduce a load of a breaker, and a method for controlling the work machine.

Solution to Problem

The work machine according to the present disclosure includes a work implement, a sensor, a control valve, and a controller. The work implement includes a breaker. The sensor detects an attitude of the work implement. The control valve controls the operation of the breaker. The controller controls the control valve. The controller detects a distance between a tip of the breaker and a striking limit from the attitude of the work implement obtained by the sensor, and when it is determined that the tip of the breaker has reached the striking limit, the controller controls the control valve to stop the operation of the breaker.

A method for controlling a work machine according to the present disclosure is a method for controlling a work machine including a work implement that includes a breaker and a control valve that controls the operation of the breaker. The method includes the following steps.

Firstly, a distance between a tip of the breaker and a striking limit from the attitude of the work implement is detected. When it is determined that the tip of the breaker has reached the striking limit, the control valve is controlled to stop the operation of the breaker.

Advantageous Effects of Invention

According to the present disclosure, it is possible to achieve a work machine that is capable of preventing any blank striking from occurring so as to reduce a load of the breaker.

DESCRIPTION OF EMBODIMENTS

Hereinafter, embodiments according to the present disclosure will be described with reference to the drawings, however, the present disclosure is not limited thereto. The components described hereinafter in each embodiment may be combined appropriately, and some components may not be disposed.

<Overall Configuration of Work Machine>

Figure 1:
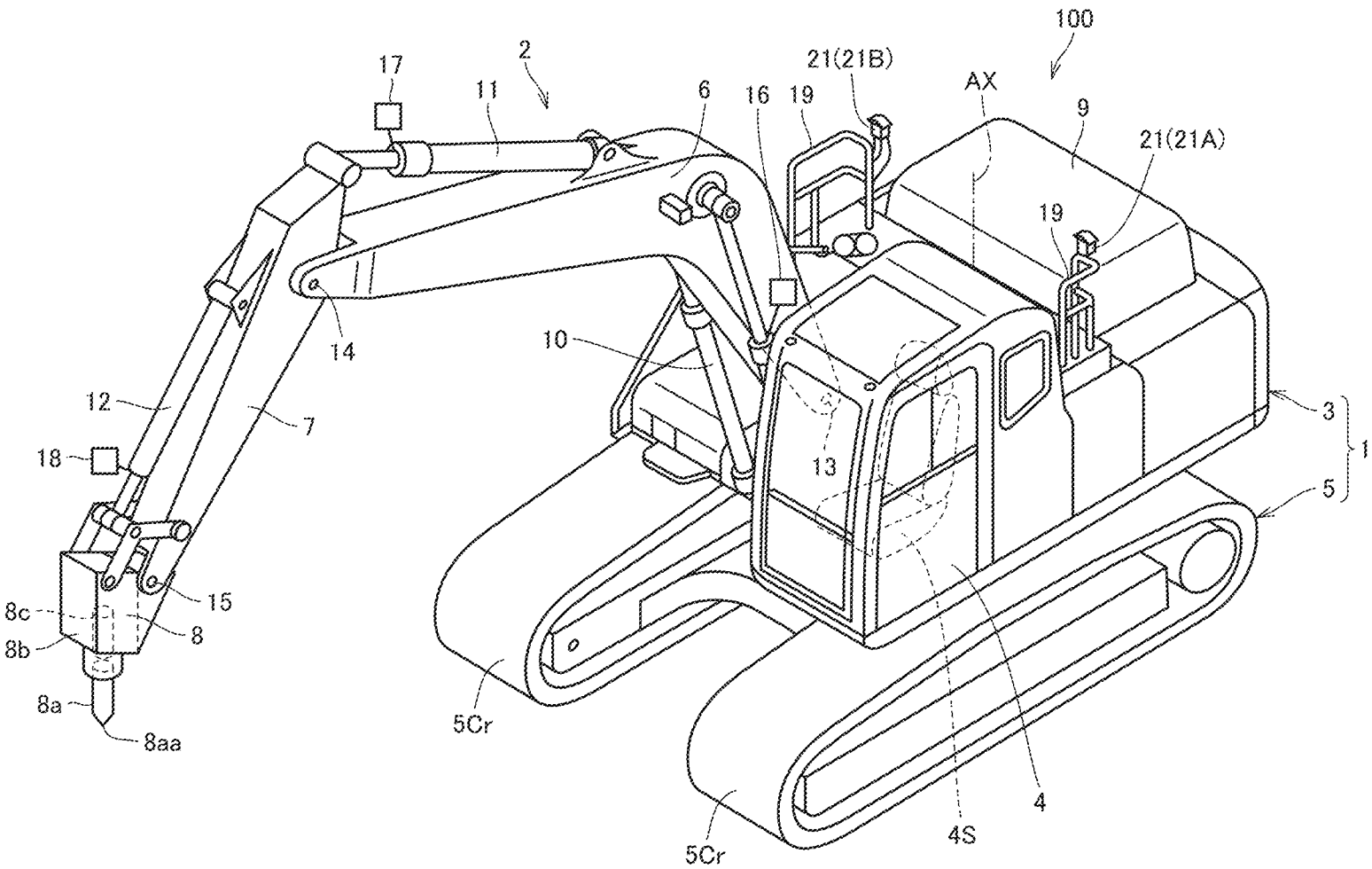
FIG. 1 is an external view illustrating a work machine 100 according to an embodiment.

FIG. 1 is an external view illustrating a work machine 100 according to an embodiment.

In the present embodiment, a hydraulic excavator illustrated in FIG. 1 will be mainly described as an example of the work machine 100.

The work machine 100 includes a vehicle main body 1 and a work implement 2 that operates with hydraulic pressure. As to be described later, the work machine 100 is equipped with a control system 200 (FIG. 3) that performs various controls.

The vehicle main body 1 has a revolving unit 3 and a traveling unit 5. The traveling unit 5 is provided with a pair of crawler belts 5Cr. The work machine 100 travels when the pair of crawler belts 5Cr rotate. The traveling unit 5 may be provided with wheels (tires).

The revolving unit 3 is disposed on the traveling unit 5 and is supported by the traveling unit 5. It is possible for the revolving unit 3 to revolve with respect to the traveling unit 5 around a revolution axis AX.

The revolving unit 3 includes an operator's cab 4. The operator's cab 4 is provided with an operator's seat 4S on which an operator is seated. The operator in the operator's cab 4 operates the work machine 100.

In the present embodiment, each of the positional relationships will be described with reference to the operator seated on the operator's seat 4S. The front-rear direction refers to the front-rear direction of the operator seated on the operator's seat 4S. The left-right direction refers to the left-right direction of the operator seated on the operator's seat 4S. The direction facing the operator seated on the operator's seat 4S is defined as the front direction, and the direction opposite to the front direction is defined as the rear direction. The right side and the left side when the operator seated in the operator's seat 4S faces the front are defined as the right direction and the left direction, respectively.

The revolving unit 3 includes an engine compartment 9 in which an engine is accommodated, and a counterweight that is provided at a rear portion of the revolving unit 3. The revolving unit 3 is provided with a handrail 19 in front of the engine compartment 9. An engine and a hydraulic pump (not shown) are arranged in the engine compartment 9.

The work implement 2 is supported by the revolving unit 3. The work implement 2 mainly includes a boom 6, an arm 7, a breaker 8, a boom cylinder 10, an arm cylinder 11, and a breaker cylinder 12. The boom 6 is connected to the revolving unit 3. The arm 7 is connected to the boom 6. The breaker 8 is connected to the arm 7.

The boom cylinder 10 is provided to drive the boom 6. The arm cylinder 11 is provided to drive the arm 7. The breaker cylinder 12 is provided to drive the breaker 8. Each of the boom cylinder 10, the arm cylinder 11 and the breaker cylinder 12 is a hydraulic cylinder driven by hydraulic oil.

The proximal end of the boom 6 is connected to the revolving unit 3 via a boom pin 13. The proximal end of the arm 7 is connected to the distal end of the boom 6 via an arm pin 14. The breaker 8 is connected to the distal end of the arm 7 via a breaker pin 15.

The boom 6 is rotatable around the boom pin 13. The arm 7 is rotatable around the arm pin 14. The breaker 8 is rotatable around the breaker pin 15.

Figure 2:
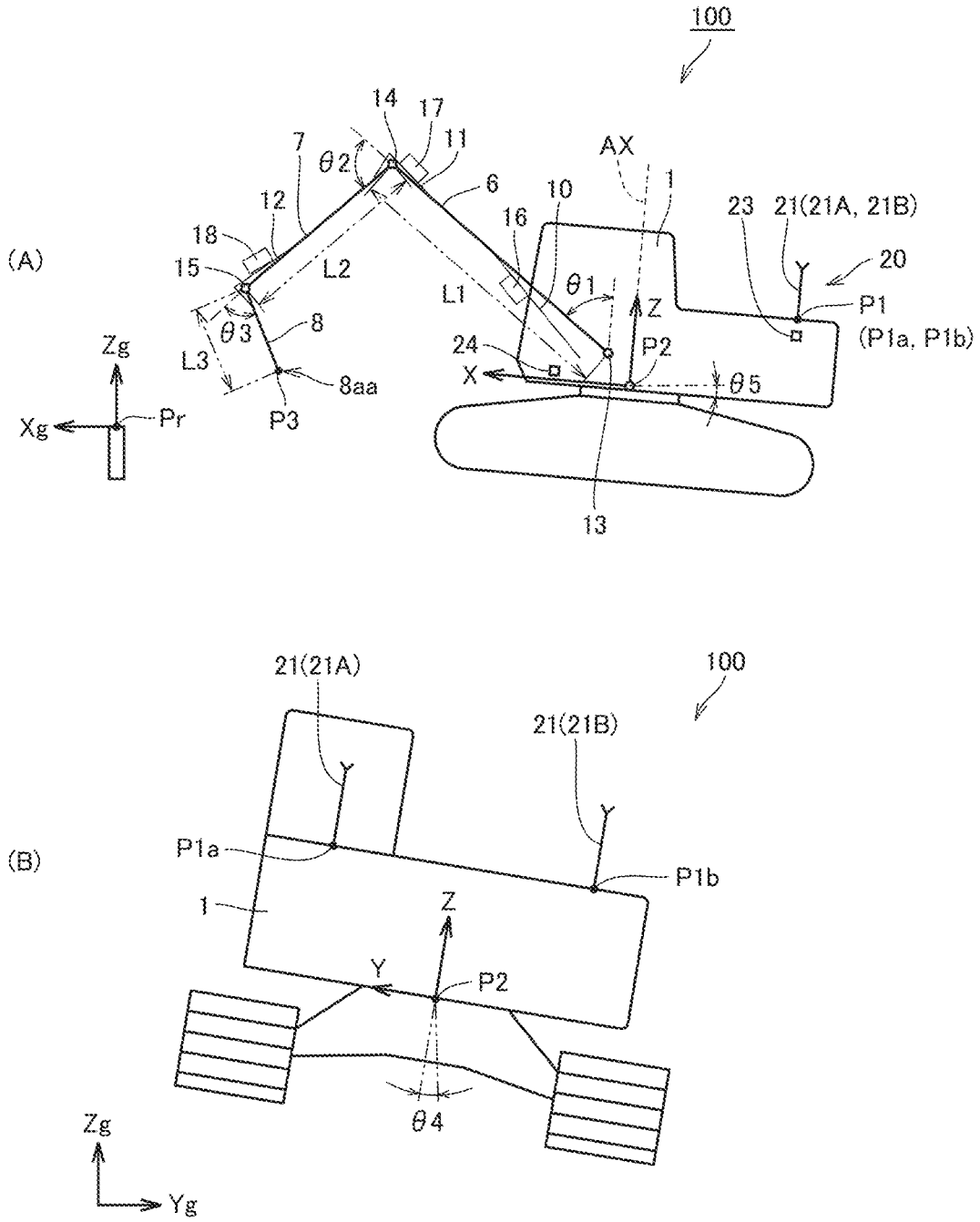
FIGS. 2A and 2B are diagrams schematically illustrating a side view and a rear view of a work machine according to an embodiment.

FIGS. 2A and 2B are diagrams schematically illustrating the work machine 100 according to an embodiment. FIG. 2A illustrates a side view of the work machine 100, and FIG. 2B illustrates a rear view of the work machine 100.

Figure 4:
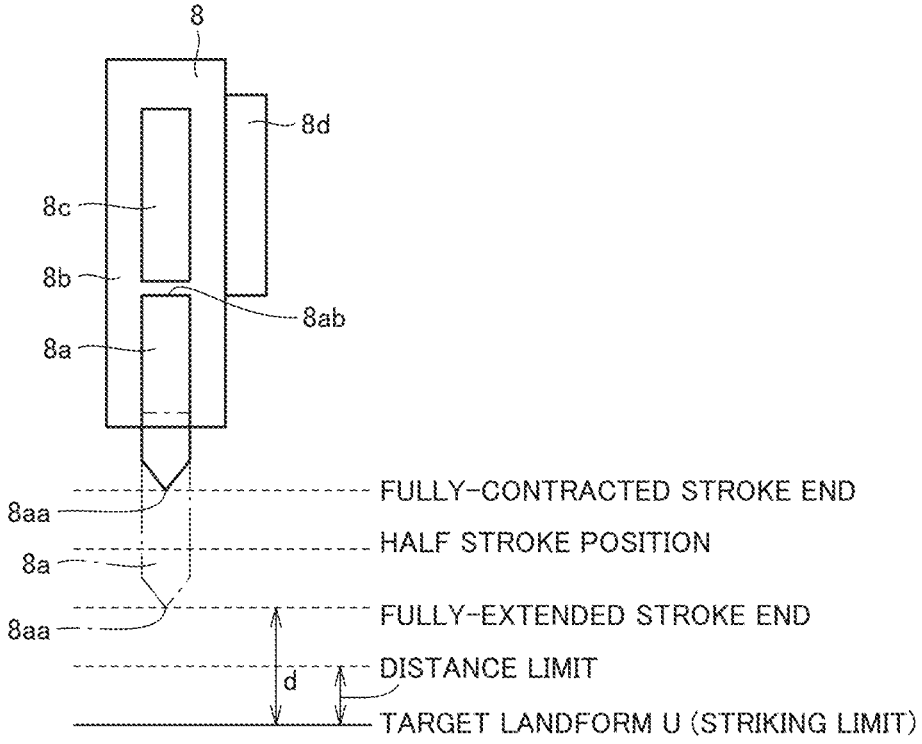
FIG. 4 is a diagram schematically illustrating the configuration of a breaker according to an embodiment.

As illustrated in FIGS. 2A and 2B, the boom 6 has a length L1 corresponding to the distance between the boom pin 13 and the arm pin 14. The arm 7 has a length L2 corresponding to the distance between the arm pin 14 and the breaker pin 15. The breaker 8 has a length L3 corresponding to the distance between the breaker pin 15 and a tip 8*aa* (of a tool 8*a*) of the breaker 8. The tool 8*a* of the breaker 8 is for example a chisel, and the tip 8*aa* of the tool 8*a* is sharp. To be described later, the length L3 is equal to the length when the tip 8*aa* of the breaker 8 is located at a fully-extended stroke end (FIG. 4).

The work machine 100 includes a boom cylinder stroke sensor 16, an arm cylinder stroke sensor 17, and a breaker cylinder stroke sensor 18. The boom cylinder stroke sensor 16 is disposed in the boom cylinder 10. The arm cylinder stroke sensor 17 is disposed in the arm cylinder 11. The breaker cylinder stroke sensor 18 is disposed in the breaker cylinder 12. The boom cylinder stroke sensor 16, the arm cylinder stroke sensor 17, and the breaker cylinder stroke sensor 18 may also be collectively referred to as a cylinder stroke sensor.

The stroke length of the boom cylinder 10 is calculated based on a detection result by the boom cylinder stroke sensor 16. The stroke length of the arm cylinder 11 is calculated based on a detection result by the arm cylinder stroke sensor 17. The stroke length of the breaker cylinder 12 is calculated based on a detection result by the breaker cylinder stroke sensor 18.

In the present embodiment, the stroke length of the boom cylinder 10, the stroke length of the arm cylinder 11, and the stroke length of the breaker cylinder 12 may also be referred to as a boom cylinder length, an arm cylinder length, and a breaker cylinder length, respectively. In the present embodiment, the boom cylinder length, the arm cylinder length and the breaker cylinder length may be collectively referred to as cylinder length data L. In addition, the stroke length may be detected by using a potentiometer or an inclination sensor.

The work machine 100 includes a position detector 20 that detects the position of the work machine 100.

The position detector 20 includes an antenna 21, a global coordinate computation unit 23, and an IMU (Inertial Measurement Unit) 24.

The antenna 21 may be, for example, a GNSS (Global Navigation Satellite System) compatible antenna. The antenna 21 may be, for example, a RTK-GNSS (Real Time Kinematic-Global Navigation Satellite System) compatible antenna.

The antenna 21 is disposed on the revolving unit 3. In the present embodiment, the antenna 21 is disposed on the handrail 19 of the revolving unit 3. The antenna 21 may be disposed at a location in the rear direction of the engine compartment 9. For example, the antenna 21 may be disposed on the counterweight of the revolving unit 3. The antenna 21 outputs a signal corresponding to a received radio wave (GNSS radio wave) to the global coordinate computation unit 23.

The global coordinate computation unit 23 detects an installation position P1 of the antenna 21 in the global coordinate system. The global coordinate system refers to a three-dimensional coordinate system (Xg, Yg, Zg) based on a reference position Pr set in a work area. In the present embodiment, the reference position Pr is set as the position of the tip of a reference pile constructed in the work area. The local coordinate system refers to a three-dimensional coordinate system (X, Y, Z) with the work machine 100 as a reference. The reference position of the local coordinate system is set as a position P2 located on the revolution axis (revolution center) AX of the revolving unit 3.

In the present embodiment, the antenna 21 includes a first antenna 21A and a second antenna 21B that are disposed on the revolving unit 3 in a manner of being spaced from each other in the vehicle width direction.

The global coordinate computation unit 23 detects an installation position P1*a* of the first antenna 21A and an installation position P1*b* of the second antenna 21B. The global coordinate computation unit 23 obtains reference position data P represented in global coordinates. In the present embodiment, the reference position data P is the data of the reference position P2 located on the revolution axis (revolution center) AX of the revolving unit 3. The reference position data P may be the data of the installation position P1.

In the present embodiment, the global coordinate computation unit 23 generates revolving unit orientation data Q based on the two installation positions P1*a* and P1*b*. The revolving unit orientation data Q is determined based on an angle formed between a straight line connecting the installation position P1*a* and the installation position P1*b* and a reference direction (for example, north) of global coordinates. The revolving unit orientation data Q indicates the direction in which the revolving unit 3 (the work implement 2) is facing. The global coordinate computation unit 23 outputs the reference position data P and the revolving unit orientation data Q to a display controller 28 (FIG. 3) to be described later.

The IMU 24 is provided in the revolving unit 3. In the present embodiment, the IMU 24 is disposed below the operator's cab 4. Specifically, a highly rigid frame is disposed in the revolving unit 3 below the operator's cab 4. The IMU 24 is disposed on the frame. The IMU 24 may be disposed at any side (right side or left side) of the revolution axis AX (i.e., the reference position P2) of the revolving unit 3. The IMU 24 detects an inclination angle θ4 where the vehicle main body 1 inclines in the left-right direction and an inclination angle θ5 where the vehicle main body 1 inclines in the front-rear direction.

<Configuration of Work Implement's Control System>

Next, an outline of the control system 200 for the work implement 2 according to an embodiment will be described.

Figure 3:
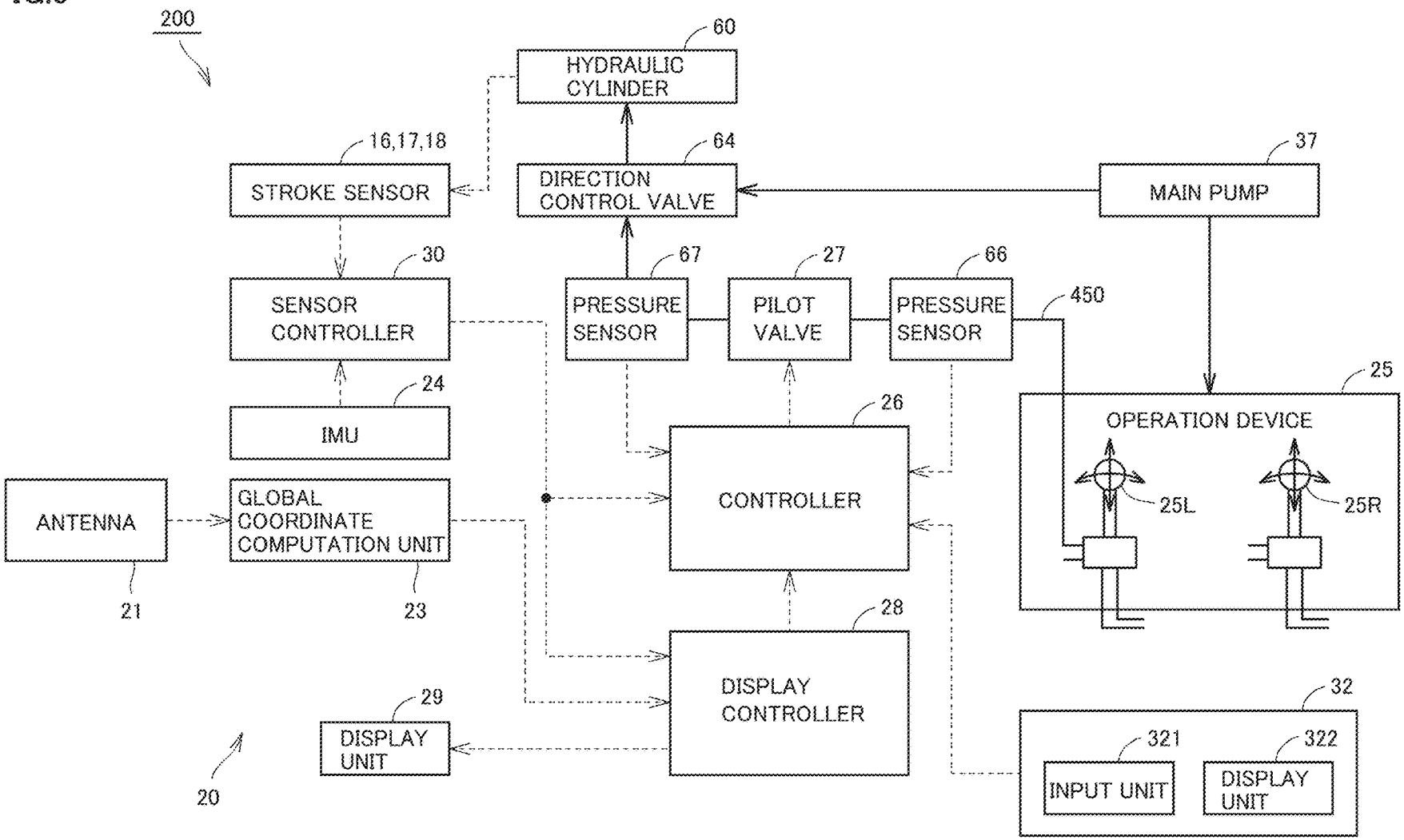
FIG. 3 is a functional block diagram illustrating the configuration of a control system for a work implement according to an embodiment.

FIG. 3 is a functional block diagram illustrating the configuration of the control system 200 for the work implement 2 according to an embodiment.

The control system 200 illustrated in FIG. 3 controls the crushing process using the work implement 2. In the present embodiment, the control of the crushing process includes a stop control of the work implement 2 and a crushing control of the breaker 8.

Figure 7:
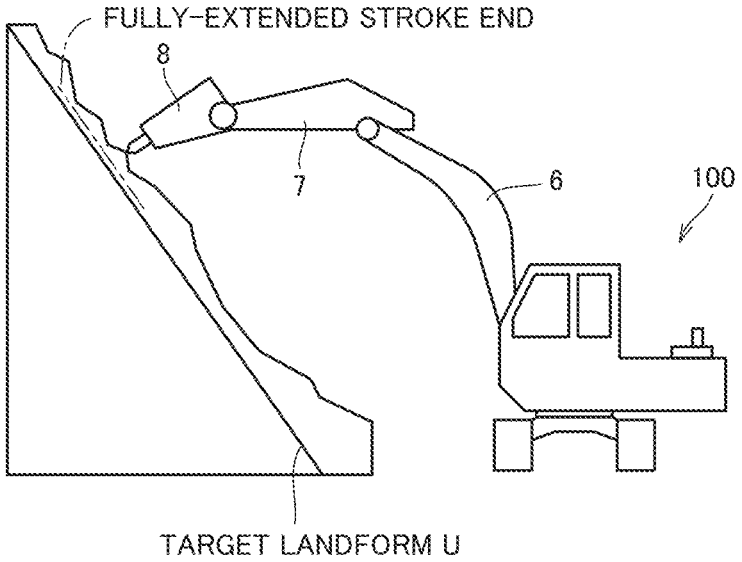
FIG. 7 is a diagram schematically illustrating an example operation of a work implement when a stop control is being performed according to an embodiment.

The stop control of the work implement 2 refers to such a control that is performed to automatically stop the work implement 2 immediately before the target landform U so as to prevent the tip 8*aa* of the breaker 8 illustrated in FIG. 1 from entering the target landform U (FIG. 7). The stop control is performed when the arm 7 is not operated but the boom 6 or the breaker 8 is operated by the operator, and the distance d between the tip 8*aa* of the breaker 8 and the target landform U and the velocity of the tip 8*aa* of the breaker 8 satisfy predetermined conditions. The target landform U refers to such a landform that is designed as a target shape of a land area to be crushed.

As illustrated in FIG. 3, the control system 200 includes the boom cylinder stroke sensor 16, the arm cylinder stroke sensor 17, the breaker cylinder stroke sensor 18, the antenna 21, the global coordinate computation unit 23, the IMU 24, an operation device 25, a controller 26, a pilot valve 27, a display controller 28, a display unit 29, a sensor controller 30, a man-machine interface 32, a main pump 37, a hydraulic cylinder 60, a direction control valve 64, a pressure sensor 66 and a pressure sensor 67.

The operation device 25 is disposed in the operator's cab 4 (FIG. 1). The operation device 25 is operated by the operator. The operation device 25 receives an operation command from the operator for driving the work implement 2. In the present embodiment, the operation device 25 is a pilot hydraulic operation device.

The direction control valve 64 adjusts the amount (pressure) of the hydraulic oil supplied to the hydraulic cylinder 60 from the main pump 37. The direction control valve 64 is operated by the hydraulic oil supplied to a first hydraulic oil chamber and a second hydraulic oil chamber. In the present embodiment, the oil supplied from the main pump 37 to the hydraulic cylinder so as to operate the hydraulic cylinder 60 (the boom cylinder 10, the arm cylinder 11, and the breaker cylinder 12) is also referred to as the hydraulic oil. The oil supplied to the direction control valve 64 to operate the direction control valve 64 is referred to as the pilot oil. The pressure of the pilot oil is also referred to as the pilot oil pressure (PPC pressure).

The hydraulic oil and the pilot oil may be discharged from the same hydraulic pump (main pump 37). For example, a part of the hydraulic oil discharged from the hydraulic pump may be decompressed by a pressure reducing valve, and the decompressed hydraulic oil may be used as the pilot oil. In addition, the hydraulic pump that pumps out the hydraulic oil (i.e., a main hydraulic pump) may be different from the hydraulic pump that pumps out the pilot oil (i.e., a pilot hydraulic pump).

The operation device 25 includes a first operation lever 25R and a second operation lever 25L. The first operation lever 25R, for example, is disposed on the right side of the operator's seat 4S (FIG. 1). The second operation lever 25L, for example, is disposed on the left side of the operator's seat 4S. The front-rear and the left-right operations of the first operation lever 25R and the second operation lever 25L correspond to the biaxial operations.

For example, the boom 6 and the breaker 8 are operated by the first operation lever 25R.

The operation of the first operation lever 25R in the front-rear direction corresponds to the operation of the boom 6, and the boom 6 is raised and lowered in response to the operation in the front-rear direction. When the first operation lever 25R is manipulated to operate the boom 6 and the pilot oil is supplied to a pilot oil passage 450, the pressure of the pilot oil is detected by the pressure sensor 66 as MB.

The left-right operation of the first operation lever 25R corresponds to the operation of the breaker 8, and the breaker 8 is rotated with respect to the arm 7 in response to the left-right operation. When the first operation lever 25R is manipulated to operate the breaker 8 and the pilot oil is supplied to the pilot oil passage 450, the pressure of the pilot oil is detected by the pressure sensor 66 as MT.

The arm 7 and the revolving unit 3, for example, are operated by the second operation lever 25L.

The operation of the second operation lever 25L in the front-rear direction corresponds to the operation of the arm 7, and the arm 7 is raised and lowered in response to the operation in the front-rear direction.

The left-right operation of the second operation lever 25L corresponds to the revolution of the revolving unit 3, and the revolving unit 3 is revolved toward the right direction and the left direction in response to the left-right operation.

The pilot oil discharged from the main pump 37 and decompressed by a pressure reducing valve is supplied to the operation device 25. The pressure of the pilot oil is adjusted in response to the operation amount of the operation device 25.

The pressure sensor 66 and the pressure sensor 67 are disposed in the pilot oil passage 450. The pressure sensor 66 and the pressure sensor 67 detect the pressure of the pilot oil. The detection results by the pressure sensor 66 and the pressure sensor 67 are output to the controller 26.

The direction control valve 64 adjusts the flow direction and the flow rate of the hydraulic oil supplied to the boom cylinder 10 for driving the boom 6 in response to the operation amount of the first operation lever 25R in the front-rear direction (the operation amount of the boom).

The direction control valve 64, through which the hydraulic oil supplied to the breaker cylinder 12 for driving the breaker 8 flows, is driven in response to the operation amount in the left-right direction of the first operation lever 25R (the operation amount of the breaker).

The direction control valve 64, through which the hydraulic oil supplied to the arm cylinder 11 for driving the arm 7, flows is driven in response to the operation amount of the second operation lever 25L in the front-rear direction (the operation amount of the arm).

The direction control valve 64, through which the hydraulic oil supplied to the hydraulic actuator for driving the revolving unit 3 flows, is driven in response to the operation amount of the second operation lever 25L in the left-right direction.

The left-right operation of the first operation lever 25R may correspond to the operation of the boom 6, and the front-rear operation of the first operation lever 25R may correspond to the operation of the breaker 8. Further, the left-right operation of the second operation lever 25L may correspond to the operation of the arm 7, and the front-rear operation of the second operation lever 25L may correspond to the operation of the revolving unit 3.

The pilot valve 27 adjusts the amount of hydraulic oil supplied to the hydraulic cylinder 60 (the boom cylinder 10, the arm cylinder 11, and the breaker cylinder 12). The pilot valve 27 operates in response to a control signal from the controller 26.

The man-machine interface 32 includes an input unit 321 and a display unit (monitor) 322.

In the present embodiment, the input unit 321 includes operation buttons arranged around the display unit 322. Note that the input unit 321 may include a touch panel. The man-machine interface 32 may also be referred to as a multi-monitor.

The display unit 322 displays basic information such as the remaining amount of fuel, the temperature of coolant, and the like. The display unit 322 may be a touch panel (input device) that may be used to operate a device by pressing an indication displayed on the screen.

The input unit 321 is operated by the operator. A command signal input from the input unit 321 is output to the controller 26.

The sensor controller 30 calculates the boom cylinder length based on a detection result by the boom cylinder stroke sensor 16. The boom cylinder stroke sensor 16 outputs a pulse involving the rotation operation to the sensor controller 30. The sensor controller 30 calculates the boom cylinder length based on the pulse output from the boom cylinder stroke sensor 16.

Similarly, the sensor controller 30 calculates the arm cylinder length based on a detection result by the arm cylinder stroke sensor 17. The sensor controller 30 calculates the breaker cylinder length based on a detection result by the breaker cylinder stroke sensor 18.

The sensor controller 30 calculates an inclination angle θ1 (FIG. 2A) of the boom 6 with respect to the vertical direction of the revolving unit 3 from the boom cylinder length calculated based on the detection result by the boom cylinder stroke sensor 16.

The sensor controller 30 calculates an inclination angle θ2 of the arm 7 with respect to the boom 6 (FIG. 2A) from the arm cylinder length calculated based on the detection result by the arm cylinder stroke sensor 17.

The sensor controller 30 calculates an inclination angle θ3 (FIG. 2A) of the tip 8*aa* of the breaker 8 with respective to the arm 7 from the breaker cylinder length calculated based on the detection result by the breaker cylinder stroke sensor 18.

Based on the calculated inclination angles θ1, θ2 and θ3, the reference position data P, the revolving unit orientation data Q, and the cylinder length data L, it is possible to specify the positions of the boom 6, the arm 7 and the breaker 8 of the work machine 100, which makes it possible to obtain the breaker position data indicating the three-dimensional position of the breaker 8.

Note that the inclination angle θ1 of the boom 6, the inclination angle θ2 of the arm 7, and the inclination angle θ3 of the breaker 8 may be detected by an angle detector such as a rotary encoder instead of the cylinder stroke sensors 16, 17 and 18. The inclination angle θ1 of the boom 6 may be detected by an angle detector attached to the boom. Similarly, the inclination angle θ2 of the arm 7 may be detected by an angle detector attached to the arm 7, and the inclination angle θ3 of the breaker 8 may be detected by an angle detector attached to the breaker 8.

<Configuration of Breaker>

Next, the configuration of the breaker 8 will be described.

FIG. 4 is a diagram schematically the configuration of a breaker according to an embodiment. As illustrated in FIG. 4, the breaker 8 mainly includes a tool 8*a*, a main body 8*b*, a piston 8*c*, and a control valve 8*d*. The tool 8*a* is, for example, a chisel. The tool 8*a* extends in a rod shape and has a sharp tip 8*aa* at a first end. The tool 8*a* is movable in the axial direction with respect to the main body 8*b*. The tip 8*aa* of the tool 8*a* protrudes from the main body 8*b*, and a second end 8*ab* of the tool 8*a* is inserted into the main body 8*b*.

The piston 8*c* is housed in the main body 8*b*. The piston 8*c* is movable within the main body 8*b*. As the piston 8*c* moves, the piston 8*c* strikes the second end 8*ab* of the tool 8*a*. When the tool 8*a* is struck by the piston 8*c*, a striking force is applied from the second end 8*ab* to the tip 8*aa*. This striking force enables the tip 8*aa* of the tool 8*a* that is being pressed against the land area to crush the land area.

The control valve 8*d* is provided to receive oil supplied from the outside so as to control the piston 8*c* inside the main body 8*b*.

Due to the movement of the tool 8*a* in the axial direction, the tip 8*aa* of the tool 8*a* is movable between a fully-extended stroke end and a fully-contracted stroke end. A middle position between the fully-extended stroke end and the fully-contracted stroke end is referred to as a half stroke position.

In the automatic stop control of the work implement 2 described above, the work implement 2 is controlled to automatically stop immediately before the target landform U so as to prevent the tip 8*aa* of the breaker 8 from entering the target landform U.

In the automatic stop control of striking by the breaker 8 to be described later, the breaker 8 is controlled to automatically stop striking at the striking limit or immediately before the striking limit so as to prevent the tip 8*aa* of the tool 8 from entering the predefined striking limit. The striking limit is set to, for example, the target landform U (designed landform). Further, the striking limit is not limited to the target landform U (designed landform), it may be set to a position other than the target landform U such as a position above the target landform U (designed landform). The striking limit may be landform or a virtual point predetermined with respect to a block such as a rock.

<Configuration of Hydraulic Circuit for Breaker's Crushing>

Next, the configuration of a hydraulic circuit of the breaker 8 to perform crushing will be described.

Figure 5:
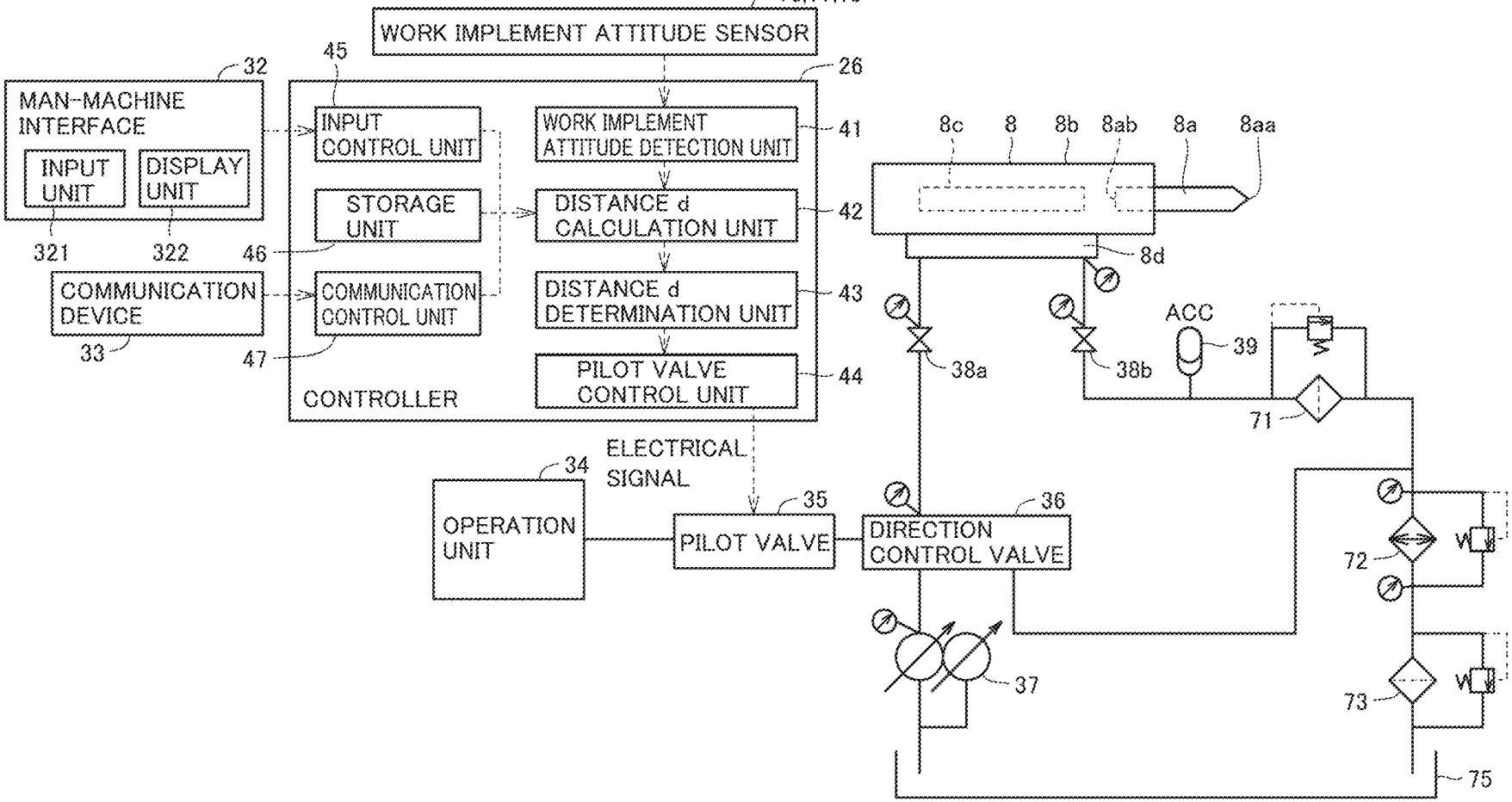
FIG. 5 is a diagram illustrating an example configuration of a hydraulic system and a control system for a breaker according to an embodiment.

FIG. 5 is a diagram illustrating an example configuration of a hydraulic system and a control system for the breaker according to an embodiment.

As illustrated in FIG. 5, the hydraulic circuit for the breaker 8 includes the breaker 8, an operation unit 34, a pilot valve 35 (control valve), the direction control valve 36, the main pump 37, stop valves 38*a* and 38*b*, an accumulator 39, filters 71 and 73, and an oil cooler 72.

The main pump 37 is provided to supply the oil stored in the oil tank 75 to the hydraulic circuit. The main pump 37 is connected to the control valve 8*d* of the breaker 8 through the intermediary of the direction control valve 36 and the stop valve 38*a*. Thereby, the main pump 37 may supply the oil stored in the oil tank 75 as the hydraulic oil to the control valve 8*d* through the intermediary of the direction control valve 36 and the stop valve 38*a*.

A spool (not shown) is disposed in the direction control valve 36. As the spool rotates in the direction control valve 36, the amount (pressure) of the hydraulic oil supplied from the main pump 37 to the control valve 8*d* of the breaker 8 is controlled. By controlling the amount (pressure) of the hydraulic oil supplied to the control valve 8*d*, it is possible to control the movement of the piston 8*c* inside the main body 8*b* of the breaker 8, which makes it possible to control the striking force to be applied to the tool 8*a*.

The pilot oil passage is connected to the direction control valve 36 from the operation unit 34 through the intermediary of the pilot valve 35. Thereby, the oil may be supplied to the direction control valve 36 as the pilot oil through the operation unit 34 and the pilot valve 35. The oil supplied to the direction control valve 36 as the pilot oil is used to rotate the spool inside the direction control valve 36.

The operation unit 34 is an operation lever or a pedal. When the operator operates this operation lever or pedal, the amount of the pilot oil supplied from the operation unit 34 to the pilot valve 35 is controlled. Thus, since the operation unit 34 may be used to control the pilot oil directly, the operation unit 34 is an operation member of a pilot hydraulic system.

The pilot valve 35 is a valve that controls the flow of the pilot oil in response to an electrical control signal (electric pressure control (EPC) current) from the controller 26. By controlling the pilot valve 35 by the controller 26, the amount (pressure) of the pilot oil supplied to the direction control valve 36 is controlled.

The hydraulic oil supplied to the breaker 8 flows through the stop valve 38*b*, the accumulator 39 and the filter 71, and returns back to the direction control valve 36. Alternatively, the hydraulic oil supplied to the breaker 8 may flow through the stop valve 38*b*, the accumulator 39, the filter 71, the oil cooler 72, and the filter 73, and return back to the oil tank 75.

<Configuration of Crushing Control System for Breaker>

Next, the configuration of a crushing control system for the breaker 8 will be described.

As illustrated in FIG. 5, the controller 26 is capable of sending an electrical control signal (EPC current) to the pilot valve 35 as described above. The controller 26 mainly includes a work implement attitude detection unit 41, a distance d calculation unit 42, a distance d determination unit 43, a pilot valve control unit 44, an input control unit 45, a storage unit 46, and a communication control unit 47.

The controller 26 is capable of detecting the distance d (FIG. 4) between the tip 8*aa* of the breaker 8 and the striking limit based on the attitude of the work implement 2 obtained from the work machine attitude detection sensors 16 to 18. Further, the controller 26 is capable of controlling the pilot valve 35 (control valve) to stop the operation of the breaker 8 when it is determined that the tip 8*aa* of the breaker 8 has reached the striking limit based on the detection of the distance d.

As described in the above, the striking limit is, for example, the target landform U (FIG. 4).

The work implement attitude detection unit 41 of the controller 26 detects the attitude of the work implement 2 based on the information detected by the work implement attitude detection sensors 16 to 18. Each of the work implement attitude detection sensors 16 to 18 is, for example, a stroke sensor as described above, but each may be a potentiometer or an inclination sensor. Since the attitude of the work implement 2 may be detected by the work implement attitude detection unit 41, it is possible to determine the position of the tip 8*aa* of the breaker 8.

The distance d calculation unit 42 calculates the distance d (FIG. 4) between the tip 8*aa* (the fully-extended stroke end) of the breaker 8 and the striking limit based on the position of the tip 8*aa* of the breaker 8 (the fully-extended stroke end) detected by the work implement attitude detection unit 41 and the position of the striking limit.

The position of the striking limit, for example, may be obtained from at least one of the input control unit 45, the storage unit 46, and the communication control unit 47. The position of the striking limit, for example, may be input into the input control unit 45 by the operator through the input unit 321 or the display unit (monitor) 322 of the man-machine interface 32. Further, the position of the striking limit may be input into the storage unit 46 before the work machine 100 is shipped. Furthermore, the position of the striking limit, for example, may be input to the communication control unit 47 from the outside of the work machine 100 through the communication device 33.

The distance d determination unit 43 determines whether or not the distance d obtained from the distance d calculation unit 42 is equal to a predetermined value. For example, the distance d determination unit 43 determines whether or not the distance d is equal to 0. Specifically, the distance d determination unit 43 determines whether or not the tip 8*aa* (the fully-extended stroke end) of the breaker 8 has reached the striking limit.

The pilot valve control unit 44 sends an electrical control signal (EPC current) to the pilot valve 35 based on the determination result by the distance d determination unit 43. For example, when the distance d determination unit 43 determines that the distance d is equal to 0 (i.e., the tip 8*aa* of the breaker 8 has reached the striking limit), an electrical control signal is sent to the pilot valve 35 so as to stop the operation of the breaker 8.

The controller 26 may be, for example, a pump controller that controls the operation of the main pump 37 or a work implement controller that controls the operation of the work implement 2.

Figure 6:
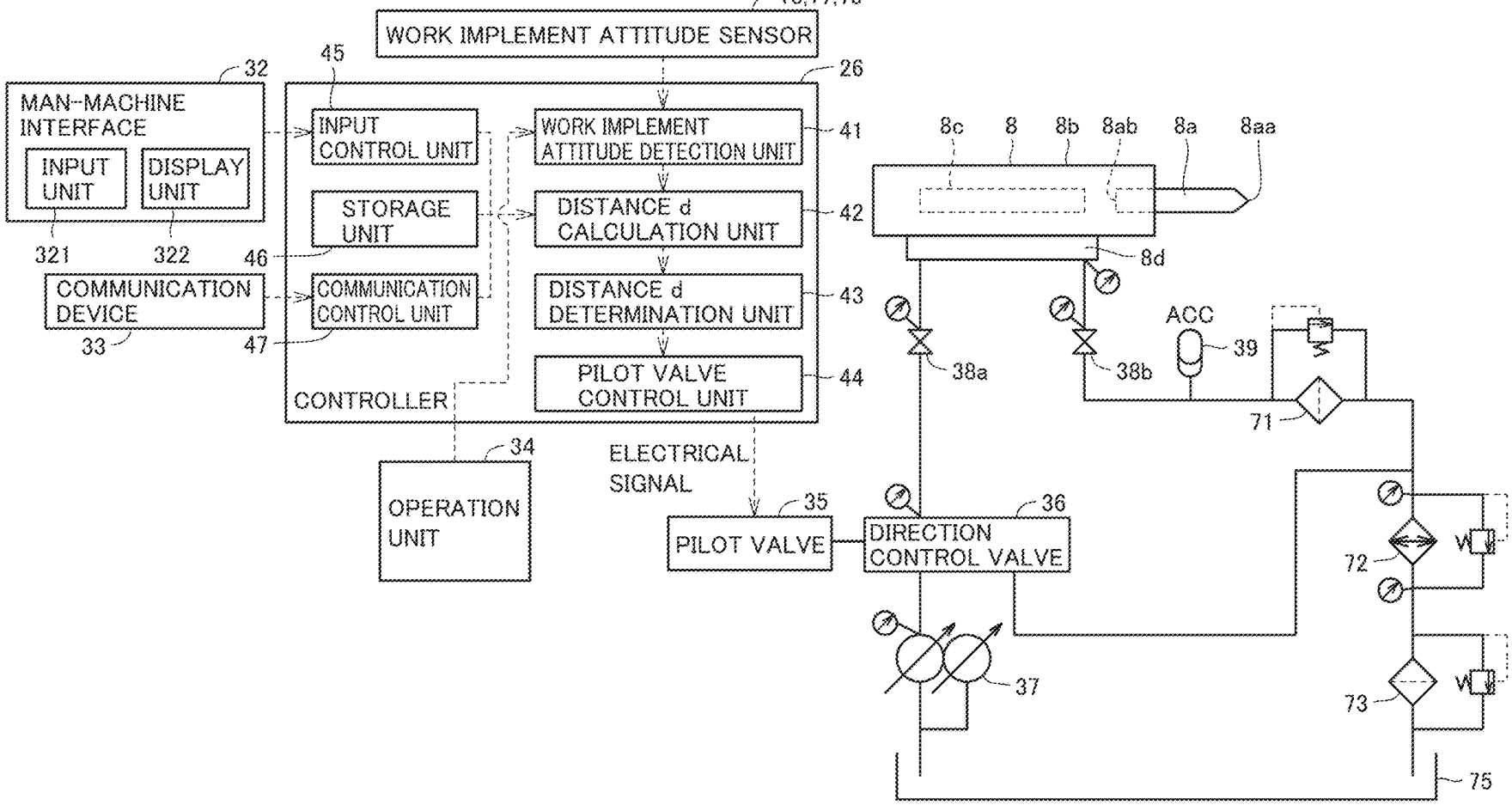
FIG. 6 is a diagram illustrating another example configuration of a hydraulic system and a control system for a breaker according to an embodiment.

In the hydraulic circuit of FIG. 5, the pilot hydraulic system in which the operation unit 34 directly controls the pilot oil has been described. However, as illustrated in FIG. 6, it is acceptable to adopt an EPC control system in which the operation unit 34 sends an electrical signal to the controller 26. FIG. 6 is a diagram illustrating the configuration of another example of a hydraulic system and a control system for the breaker according to the present embodiment.

As illustrated in FIG. 6, in this EPC control system, the operation unit 34 is electrically connected to the controller 26. Thereby, an electrical signal from the operation unit 34 may be input to the controller 26. The electrical signal from the operation unit 34 is input to the work implement attitude detection unit 41, for example.

Further, the pilot oil is supplied to the direction control valve 36 through the pilot valve 35 without flowing through the operation unit 34.

Other than those described above, the configuration of the hydraulic circuit and the configuration of the control system illustrated in FIG. 6 are substantially the same as that illustrated in FIG. 5, and thus, the same elements are denoted by the same reference numerals and the description thereof will not be repeated.

<Operation of Hydraulic System in Normal Control and Automatic Control (Stop Control)>

[Normal Control]

In the normal control, the work implement 2 operates according to the operation amount of the operation device 25.

Specifically, as illustrated in FIG. 3, the controller 26 opens the pilot valve 27. With the pilot valve 27 opened, the pilot oil pressure (PPC pressure) is adjusted based on the operation amount of the operation device 25. Thereby, the direction control valve 64 is adjusted, and as a result, it is possible to raise or lower each of the boom 6, the arm 7 and the breaker 8.

[Automatic Control (Stop Control)]

In the automatic control (stop control), the work implement 2 is controlled by the controller 26 according to the operation amount of the operation device 25.

Specifically, as illustrated in FIG. 3, the controller 26 outputs a control signal to the pilot valve 27. The pilot valve 27 operates in response to a control signal from the controller 26. Thereby, the pilot oil pressure acting on the direction control valve 64 connected to the hydraulic cylinder 60 (the direction control valve 64 connected to each of the boom cylinder 10 and the breaker cylinder 12) is controlled.

The direction control valve 64 operates according to the pilot oil pressure controlled by the pilot valve 27. In response to the operation of the direction control valve 64, the pressure of the hydraulic oil supplied to the hydraulic cylinder 60 (the boom cylinder 10 and the breaker cylinder 12) is controlled. Thus, the controller 26 controls (stops) the movement of the boom 6 so as to prevent the tip 8*aa* of the breaker 8 from entering the target landform U (FIG. 7).

In the present embodiment, the controller 26 outputs a control signal to the pilot valve 27 connected to the boom cylinder 10 to control the position of the boom 6 so as to prevent the tip 8*aa* from entering the target landform U. This process is called a stop control.

The position of the tip 8*aa* of the breaker 8 in the automatic control (stop control) corresponds to the position of the fully-extended stroke end of the tool 8*a* as illustrated in FIG. 4.

FIG. 7 is a diagram schematically illustrating an example operation of the work implement when a stop control is being performed according to an embodiment.

As illustrated in FIG. 7, in the stop control, the stop control is performed to control the boom 6 so as to prevent the breaker 8 from entering the target landform U. Specifically, the control system 200 (FIG. 3) controls the boom 6 in such a manner that the breaker 8 moves at a smaller velocity toward the target landform U as the tip 8*aa* (the fully-extended stroke end) of the breaker 8 approaches closer to the target landform U.

Then, as the position of the tip 8*aa* (the fully-extended stroke end) of the breaker 8 reaches the target landform U or immediately before the target landform U, the work implement 2 is stopped. Thereby, when the work implement 2 is stopped, the position of the fully-extended stroke end of the tool 8*a* is at the target landform U or immediately before the target landform U.

When the work implement 2 is stopped, since the tip 8*aa* of the tool 8*a* is actually in contact with the surface of the landform to be crushed, it is closer to the fully-contracted stroke end than to the fully-extended stroke end. In this state, the tip 8*aa* of the tool 8*a*, for example, is actually positioned at the fully-contracted stroke end.

Figure 8:
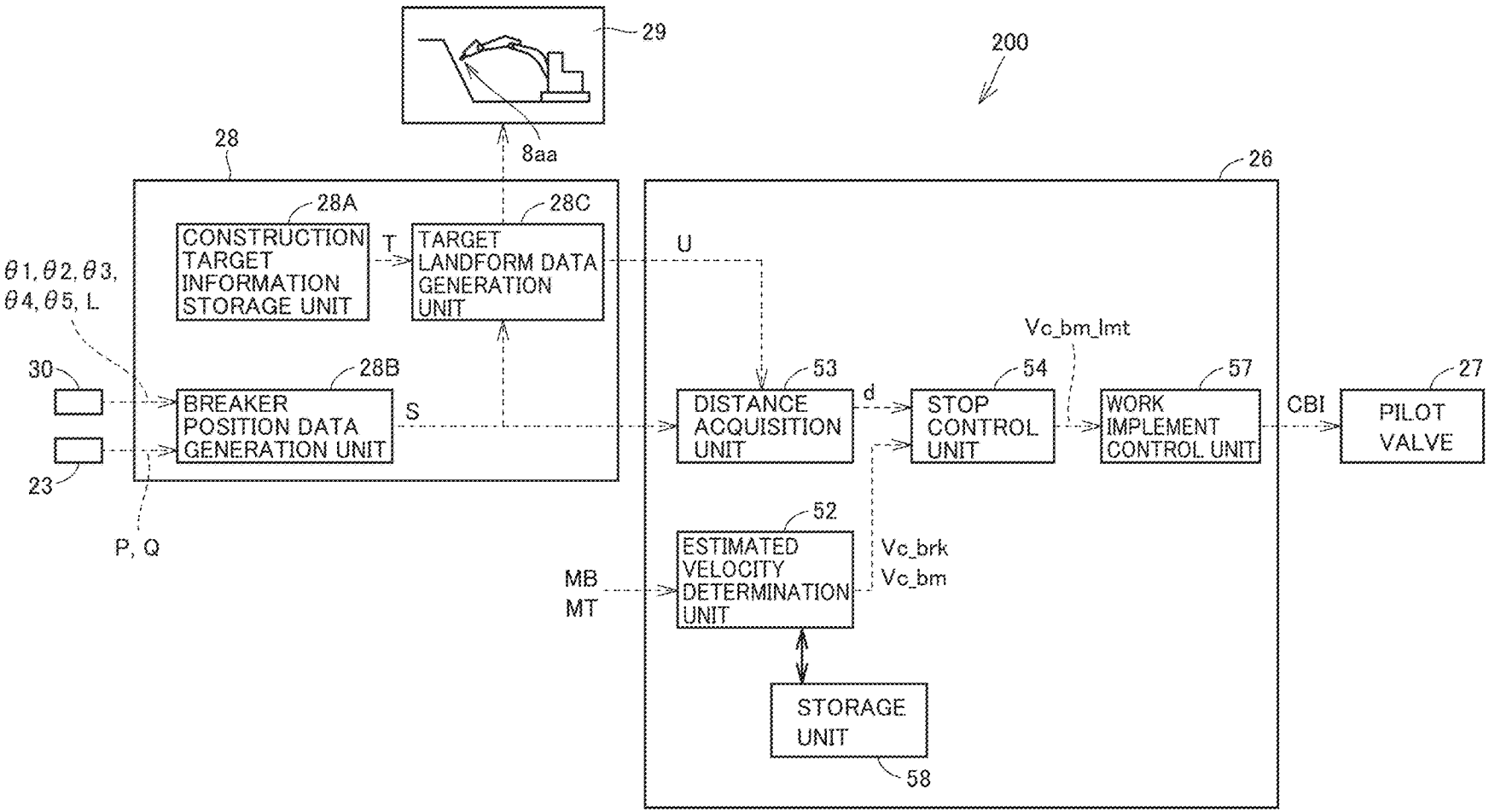
FIG. 8 is a functional block diagram illustrating a controller 26 and a display controller 28 included in a control system 200 that performs a stop control according to an embodiment.

FIG. 8 is a functional block diagram illustrating the controller 26 and the display controller 28 included in the control system 200 that performs the stop control according to an embodiment.

Functional blocks of the controller 26 and the display controller 28 included in the control system 200 are illustrated in FIG. 8.

Hereinafter, the stop control of the boom 6 will be described. As described above, the stop control is performed when the tip 8*aa* (the fully-extended stroke end) of the breaker 8 approaches the target landform U from above the target landform U by the boom lowering operation by the operator to control the movement of the boom 6 so as to prevent the tip 8*aa* (the fully-extended stroke end) of the breaker 8 from entering the target landform U.

Specifically, the controller 26 calculates the distance d between the target landform U and the breaker 8 based on the target landform U that is the target shape of a land area to be crushed and breaker position data S indicating the position of the tip 8*aa* of the breaker 8. Then, a control signal CBI for stopping the boom 6 is output to the pilot valve 27 so as to lower the velocity at which the breaker 8 approaches the target landform U in response to the distance d.

First, the controller 26 calculates the velocity of the tip 8*aa* of the breaker 8 that will be operated by the boom 6 and the breaker 8 based on an operation command input from the operation device 25 (FIG. 3). Based on the calculation result, a boom limit velocity (target velocity) for controlling the boom 6 is calculated so that the tip 8*aa* (the fully-extended stroke end) of the breaker 8 will not enter the target landform U. Then, the control signal CBI is output to the pilot valve 27 so that the boom 6 operates at the boom velocity limit.

Hereinafter, the functional blocks will be specifically described with reference to FIG. 8.

As illustrated in FIG. 8, the display controller 28 includes a construction target information storage unit 28A, a breaker position data generation unit 28B, and a target landform data generation unit 28C. The display controller 28 may calculate the position of local coordinates when viewed in the global coordinate system based on the detection result by the position detector 20 (FIG. 3).

The display controller 28 receives an input from the sensor controller 30.

The sensor controller 30 acquires the cylinder length data L and the inclination angles θ1, θ2 and θ3 from the detection results by the cylinder stroke sensors 16, 17 and 18. Further, the sensor controller 30 acquires the data of the inclination angle θ4 and the inclination angle θ5 output from the IMU 24. The sensor controller 30 outputs the cylinder length data L, the data of the inclination angles θ1, θ2 and θ3, the data of the inclination angle θ4, and the data of the inclination angle θ5 to the display controller 28.

As described above, in the present embodiment, the detection results by the cylinder stroke sensors 16, 17 and 18 and the detection result by the IMU 24 are output to the sensor controller 30, and the sensor controller 30 performs a predetermined computation process.

In the present embodiment, the function performed by the sensor controller 30 may be alternatively performed by the controller 26. For example, the detection results by the cylinder stroke sensors 16, 17 and 18 are output to the controller 26, and the controller 26 may calculate the cylinder length (the boom cylinder length, the arm cylinder length, and the breaker cylinder length) based on the detection results by the cylinder stroke sensors 16, 17 and 18. The detection result by the IMU 24 may be output to the controller 26.

The global coordinate computation unit 23 acquires the reference position data P and the revolving unit orientation data Q and outputs them to the display controller 28.

The construction target information storage unit 28A stores construction target information (designed three-dimensional landform data) T indicating the three-dimensional landform that is the target shape of a land area. The construction target information T includes coordinate data and angle data required for generating a target landform (designed landform data) U indicating a landform that is designed as a target shape of a land area to be crushed. The construction target information T may be sent to the display controller 28 via, for example, a wireless communication device.

The breaker position data generation unit 28B generates breaker position data S that indicates the three-dimensional position of the breaker 8 based on the inclination angles θ1, θ2, θ3, θ4 and θ5, the reference position data P, the revolving unit orientation data Q, and the cylinder length data L. The position information of the tip 8*aa* may be transmitted from a connection-type recording device such as a memory.

In the present embodiment, the breaker position data S indicates the three-dimensional position of the tip 8*aa*.

The target landform data generation unit 28C generates the target landform U that indicates the target shape of a land area to be crushed using the breaker position data S acquired from the breaker position data generation unit 28B and the construction target information T (to be described later) stored in the construction target information storage unit 28A.

The target landform data generation unit 28C outputs data related to the generated target landform data U to the display unit 29. Thereby, the display unit 29 displays the target landform U.

The display unit 29 is a monitor, for example, and displays various types of information about the work machine 100. In the present embodiment, the display unit 29 includes an HMI (Human Machine Interface) monitor as a monitor for guiding computerized construction.

The target landform data generation unit 28C outputs data related to the target landform U to the controller 26. In addition, the breaker position data generation unit 28B outputs the generated breaker position data S to the controller 26.

The controller 26 includes an estimated velocity determination unit 52, a distance acquisition unit 53, a stop control unit 54, a work implement control unit 57, and a storage unit 58.

The controller 26 acquires an operation command (the pressure MB, the pressure MT) from the operation device 25 (FIG. 3), the breaker position data S and the target landform U from the display controller 28, and sends a control signal CBI to the pilot valve 27. Further, the controller 26 acquires from the sensor controller 30 and the global coordinate computation unit 23 where necessary various parameters required by the computation process.

The estimated velocity determination unit 52 calculates an estimated boom velocity Vc_bm and an estimated breaker velocity Vc_brk corresponding to the lever operation of the operation device 25 (FIG. 3) for driving the boom 6 and the breaker 8.

Here, the estimated boom velocity Vc_bm is the velocity of the tip 8*aa* of the breaker 8 when it is driven by the boom cylinder 10 only. The estimated breaker velocity Vc_brk is the velocity of the tip 8*aa* of the breaker 8 when it is driven by the breaker cylinder 12 only.

The estimated velocity determination unit 52 calculates an estimated boom velocity Vc_bm corresponding to the boom operation command (the pressure MB). Similarly, the estimated velocity determination unit 52 calculates an estimated breaker velocity Vc_brk corresponding to the breaker operation command (the pressure MT). Thereby, it is possible to calculate the velocity of the tip 8*aa* of the breaker 8 corresponding to each operation command.

The storage unit 58 stores data such as various tables used by the estimated velocity determination unit 52 to perform the computation process.

The distance acquisition unit 53 acquires data of the target landform U from the target landform data generation unit 28C. The distance acquisition unit 53 acquires the breaker position data S indicating the position of the tip 8*aa* (the fully-extended stroke end) of the breaker 8 from the breaker position data generation unit 28B. The distance acquisition unit 53 calculates the distance d between the tip 8*aa* (the fully-extended stroke end) of the breaker 8 and the target landform U in a direction perpendicular to the target landform U based on the breaker position data S and the target landform U.

The stop control unit 54 performs the stop control when the tip 8*aa* (the fully-extended stroke end) of the breaker 8 approaches the target landform U so as to stop the operation of the work implement 2 before the tip 8*aa* (the fully-extended stroke end) of the breaker 8 reaches the target landform U.

The stop control unit 54 determines a velocity limit Vc_bm_lmt of the boom 6 from the estimated velocities Vc_bm and Vc_brk acquired from the estimated velocity determination unit 52. The stop control unit 54 sends the determined velocity limit Vc_bm_lmt to the work implement control unit 57.

The work implement control unit 57 acquires the boom velocity limit Vc_bm_lmt and generates a control signal CBI based on the boom velocity limit Vc_bm_lmt. The work implement control unit 57 sends the control signal CBI to the pilot valve 27.

Thereby, the pilot valve 27 connected to the boom cylinder 10 is controlled so as to perform the stop control of the boom 6.

<Determination of Estimated Velocity>

The estimated velocity determination unit 52 in FIG. 8 calculates the estimated boom velocity Vc_bm corresponding to the boom operation command (pressure MB) and the estimated breaker velocity Vc_brk corresponding to the breaker operation command (pressure MT).

The estimated velocity determination unit 52 includes a spool stroke calculation unit, a cylinder velocity calculation unit, and an estimated velocity calculation unit.

The spool stroke calculation unit calculates a spool stroke of a spool (not shown) for the hydraulic cylinder 60 based on a spool stroke table mapped to operation commands (pressures) stored in the storage unit 58. The spool is included in the direction control valve 64 (FIG. 3).

The movement amount of the spool is adjusted by the pressure of the oil passage (pilot oil pressure) which is controlled by the operation device 25 or the pilot valve 27. The pilot oil pressure in the oil passage is the pressure of the pilot oil in the oil passage for moving the spool, and is adjusted by the operation device 25 or the pilot valve 27. Therefore, the movement amount of the spool (spool stroke) is correlated to the PPC pressure.

The cylinder velocity calculation unit calculates a cylinder velocity of the hydraulic cylinder 60 based on a cylinder velocity table mapped to the calculated spool stroke amount.

The cylinder velocity of the hydraulic cylinder 60 is adjusted based on the amount of hydraulic oil supplied per unit time from the main pump 37 via the direction control valve 64 as illustrated in FIG. 3. The amount of hydraulic oil supplied per unit time to the hydraulic cylinder 60 is adjusted based on the movement amount of the spool. Therefore, the cylinder velocity is correlated to the movement amount of the spool (spool stroke).

The estimated velocity calculation unit calculates an estimated velocity based on an estimated velocity table mapped to the calculated cylinder velocity of the hydraulic cylinder 60.

Since the work implement 2 (the boom 6, the arm 7 and the breaker 8) operates according to the cylinder velocity of the hydraulic cylinder 60, the cylinder velocity is correlated to the estimated velocity.

Through the above processing, the estimated velocity determination unit 52 calculates the estimated boom velocity Vc_bm corresponding to the boom operation command (pressure MB) and the estimated breaker velocity Vc_brk corresponding to the breaker operation command (pressure MT). The spool stroke table, the cylinder velocity table, and the estimated velocity table are provided for the boom 6 and the breaker 8, respectively, are obtained based on experiments or simulations, and are preliminarily stored in the storage unit 58.

Thereby, it is possible to calculate the target velocity (estimated velocity) of the tip 8*aa* of the breaker 8 corresponding to each operation command.

<Conversion of Estimated Velocity to Vertical Velocity Component>

In order to calculate the boom velocity limit, it is necessary to calculate velocity components Vcy_bm and Vcy_brk in the direction perpendicular to the surface of the target landform U (i.e., the vertical velocity components) of the estimated velocities Vc_bm and Vc_brk of the boom 6 and the breaker 8, respectively. Firstly, a method of calculating the vertical velocity components Vcy_bm and Vcy_brk will be described.

Figure 9:
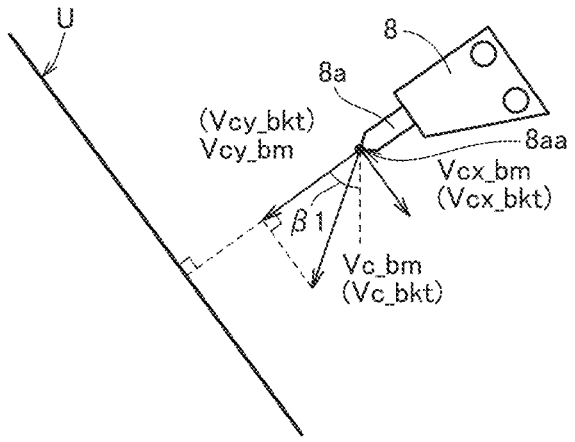
FIGS. 9A to 9C are diagrams for explaining a method of calculating vertical velocity components Vcy_bm and Vcy_brk according to an embodiment.
Figure 9:
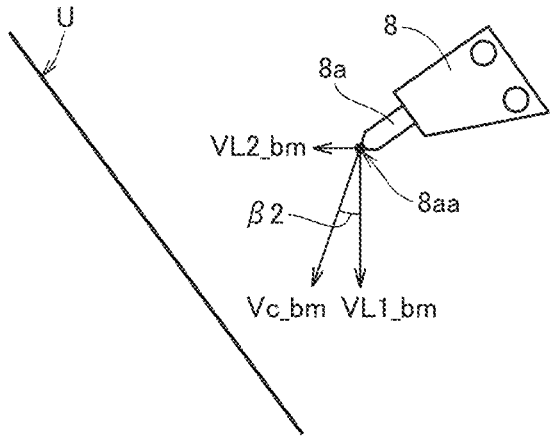
Figure 9:
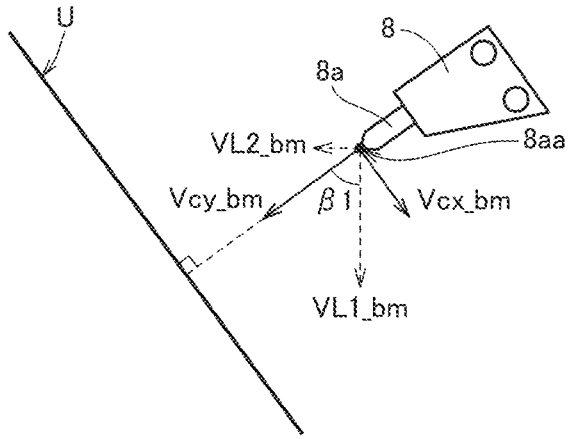

FIG. 9A to FIG. 9C are diagrams for explaining a method of calculating the vertical velocity components Vcy_bm and Vcy_brk according to the present embodiment.

As illustrated in FIG. 9A, the stop control unit 54 (FIG. 8) converts the estimated boom velocity Vc_bm into a velocity component Vcy_bm in the direction perpendicular to the surface of the target landform U (vertical velocity component) and a velocity component Vcx_bm in a direction parallel to the surface of the target landform U (horizontal velocity component).

At first, the stop control unit 54 determines an inclination of the vertical axis (the revolution axis AX of the revolving unit 3 in FIG. 1) of the local coordinate system relative to the vertical axis of the global coordinate system and an inclination of the vertical direction to the surface of the target landform U relative to the vertical axis of the global coordinate system from the inclination angle and the target landform U acquired from the sensor controller 30 (FIG. 3). The stop control unit 54 determines an angle 131 representing the inclination between the vertical axis of the local coordinate system and the vertical direction to the surface of the target landform U from the above inclinations.

Then, as illustrated in FIG. 9B, the stop control unit 54 uses a trigonometric function to convert the estimated boom velocity Vc_bm into a velocity component VL1_*bm* in the vertical axis direction of the local coordinate system and a velocity component VL2_*bm* in the horizontal axis direction of the local coordinate system from an angle 132 formed between the vertical axis direction of the local coordinate system and the direction of the estimated boom velocity Vc_bm.

Next, as illustrated in FIG. 9C, the stop control unit 54 uses a trigonometric function to convert the velocity component VL1_*bm* in the vertical axis direction of the local coordinate system and the velocity component VL2_*bm* in the horizontal axis direction of the local coordinate system into a vertical velocity component Vcy_bm perpendicular to the surface of the target landform U and a horizontal velocity component Vcx_bm parallel to the surface of the target land form U from the inclination angle 131 between the vertical axis of the local coordinate system and the vertical direction to the surface of the target fracture landform U. Similarly, the stop control unit 54 converts the estimated breaker velocity Vc_brk into a vertical velocity component Vcy_brk in the vertical axis direction of the local coordinate system and a horizontal velocity component Vcx_brk in the horizontal axis direction of the local coordinate system.

As mentioned above, the vertical velocity components Vcy_bm and Vcy_brk are calculated.

<Calculation of Distance d Between Tip of Breaker and Target Landform U>

Figure 10:
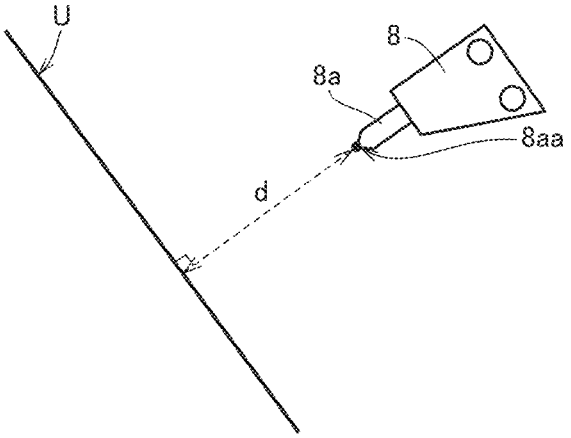
FIG. 10 is a diagram for explaining how to obtain a distance d between the tip of the breaker and a target landform U according to an embodiment.

FIG. 10 is a diagram for explaining how to obtain the distance d between the tip 8*aa* (the fully-extended stroke end) of the breaker 8 and the target landform U according to an embodiment.

As illustrated in FIG. 10, the distance acquisition unit 53 (FIG. 8) calculates the shortest distance d between the tip 8*aa* (the fully-extended stroke end) of the breaker 8 and the surface of the target landform U based on the position information of the tip 8*aa* of the breaker 8 (the breaker position data S).

In the present embodiment, the stop control is performed based on the shortest distance d between the tip 8*aa* (the fully-extended stroke end) of the breaker 8 and the surface of the target landform U.

<Flowchart of Stop Control>

Next, an example flow of a stop control of the work implement according to the present embodiment will be described with reference to FIGS. 8 to 11.

Figure 11:
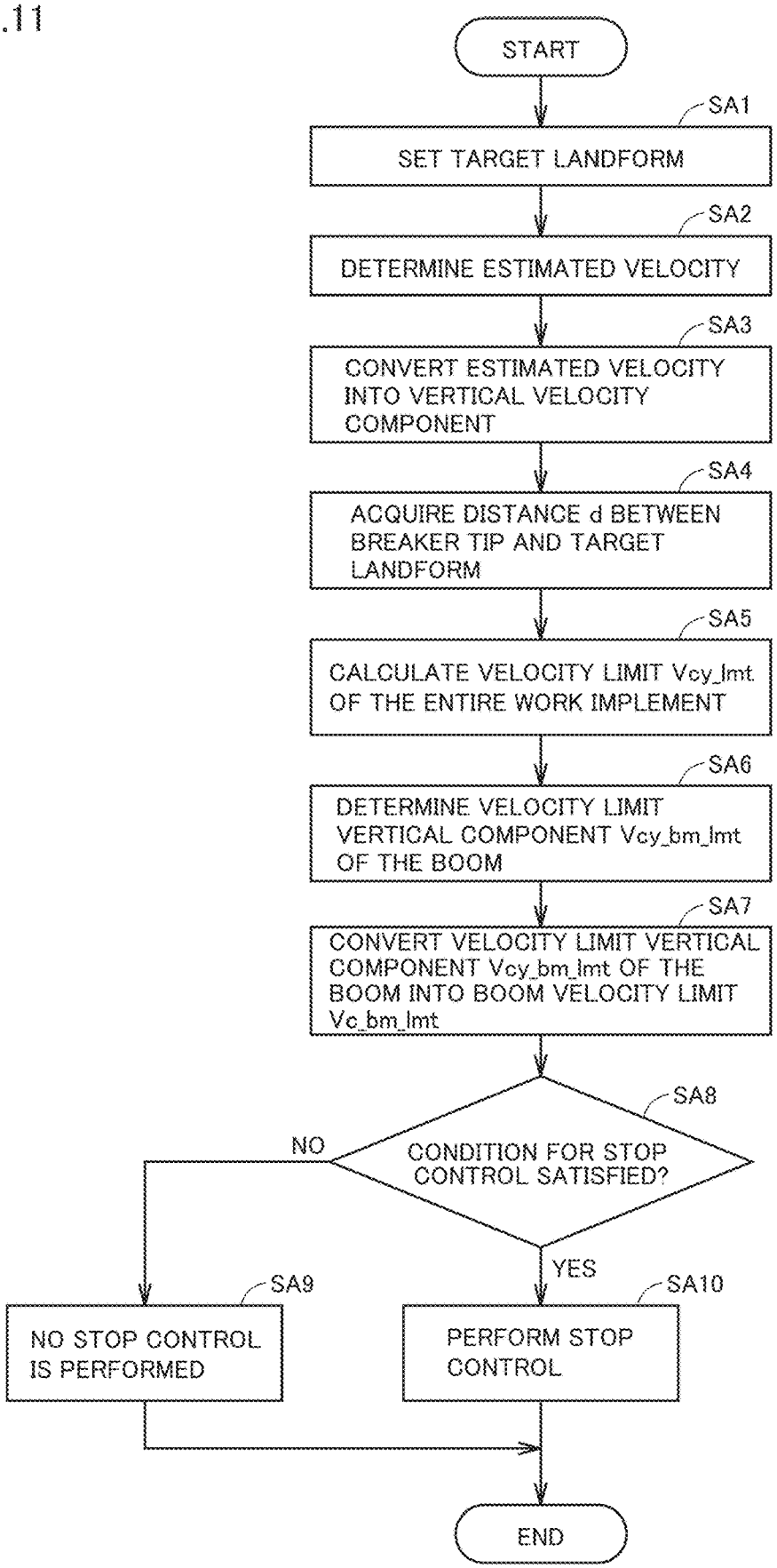
FIG. 11 is a flowchart illustrating an example of an automatic stop control of the work implement according to an embodiment.

FIG. 11 is a flowchart illustrating an example of a stop control of the work implement according to an embodiment.

As illustrated in FIG. 11, firstly, the target landform U is set (step SA1 in FIG. 11).

After the target landform U is set, as illustrated in FIG. 8, the controller 26 determines an estimated velocity Vc of the work implement 2 (step SA2 in FIG. 11). The estimated velocity Vc of the work implement 2 includes the estimated boom velocity Vc_bm and the estimated breaker velocity Vc_brk. The estimated boom velocity Vc_bm is calculated based on the boom operation amount. The estimated breaker velocity Vc_brk is calculated based on the breaker operation amount.

The storage unit 58 of the controller 26 stores estimated velocity information that defines the relationship between the boom operation amount and the estimated boom velocity Vc_bm. The controller 26 determines the estimated boom velocity Vc_bm corresponding to the boom operation amount based on the estimated velocity information. The estimated velocity information is, for example, a map that describes the magnitude of the estimated boom velocity Vc_bm corresponding to the boom operation amount. The estimated velocity information may be in the form of a table or a mathematical expression.

The estimated velocity information further includes information that defines the relationship between the breaker operation amount and the estimated breaker velocity Vc_brk. The controller 26 determines the estimated breaker velocity Vc_brk corresponding to the breaker operation amount based on the estimated velocity information.

As illustrated in FIG. 9A, the controller 26 converts the estimated boom velocity Vc_bm into the velocity component Vcy_bm in the direction perpendicular to the surface of the target landform U (vertical velocity component) and the velocity component Vcx_bm in the direction parallel to the surface of the target landform U (horizontal velocity component) (step SA3 in FIG. 11).

The controller 26 determines an inclination of the vertical axis of the local coordinate system (the revolution axis AX of the revolving unit 3) relative to the vertical axis of the global coordinate system and an inclination of the vertical direction to the surface of the target landform U relative to the vertical axis of the global coordinate system from the reference position data P and the target landform U. The controller 26 determines an angle (31 (FIG. 9A) representing the inclination between the vertical axis of the local coordinate system and the vertical direction to the surface of the target landform U from the above inclinations.

As illustrated in FIG. 9B, the controller 26 uses a trigonometric function to convert the estimated boom velocity Vc_bm into a velocity component VL1_*bm* in the vertical axis direction of the local coordinate system and a velocity component VL2_*bm* in the horizontal axis direction of the local coordinate system from an angle 132 formed between the vertical axis direction of the local coordinate system and the direction of the estimated boom velocity Vc_bm in the horizontal axis direction of the local coordinate system.

As illustrated in FIG. 9C, the controller 26 uses a trigonometric function to convert the velocity component VL1_*bm* in the vertical axis direction of the local coordinate system and the velocity component VL2_*bm* in the horizontal axis direction of the local coordinate system into a vertical velocity component Vcy_bm perpendicular to the surface of the target landform U and a horizontal velocity component Vcx_bm parallel to the surface of the target land form U from the inclination angle 131 between the vertical axis of the local coordinate system and the vertical direction to the surface of the target fracture landform U. Similarly, the controller 26 converts the estimated breaker velocity Vc_brk into a vertical velocity component Vcy_brk in the vertical axis direction of the local coordinate system and a horizontal velocity component Vcx_brk.

As illustrated in FIG. 10, the controller 26 acquires the distance d between the tip 8*aa* (the fully-extended stroke end) of the breaker 8 and the target landform U (step SA4 in FIG. 11). The controller 26 calculates the shortest distance d between the tip 8*aa* of the breaker 8 and the surface of the target landform U from the position information of the tip 8*aa* (the fully-extended stroke end), the target landform U and the like. In the present embodiment, the stop control is performed based on the shortest distance d between the tip 8*aa* (the fully-extended stroke end) of the breaker 8 and the surface of the target landform U.

The controller 26 calculates a velocity limit Vcy_lmt of the entire work implement 2 based on the distance d (step SA5 in FIG. 11). The velocity limit Vcy_lmt of the entire work implement 2 is a velocity of the tip 8*aa* that is allowed to move in a direction along which the tip 8*aa* (the fully-extended stroke end) of the breaker 8 approaches the target landform U (also referred to as an allowable velocity or a tip velocity limit). The storage unit 54*a* (FIG. 8) of the controller 26 stores velocity limit information that defines the relationship between the distance d and the velocity limit Vcy_lmt. The velocity limit Vcy_lmt of the entire work implement 2 is calculated from the velocity limit information and the distance d calculated in the above.

After acquiring the velocity limit Vcy_lmt, the controller 26 uses the velocity limit Vcy_lmt of the entire work implement 2, the estimated boom velocity Vc_bm and the estimated breaker velocity Vc_brk to calculate a vertical velocity component (velocity limit vertical component) Vcy_bm_lmt of the velocity limit (target velocity) of the boom 6 (step SA6 in FIG. 11).

The controller 26 determines the relationship between the direction perpendicular to the surface of the target landform U and the direction of the boom velocity limit Vc_bm_lmt from a rotation angle α of the boom 6, a rotation angle β of the arm 7, a rotation angle of the breaker 8, the reference position data P, the target landform U and the like, and converts the velocity limit vertical component Vcy_bm_lmt of the boom 6 into the boom velocity limit Vc_bm_lmt (step SA7 in FIG. 11). The calculation in this case is performed in a reverse order to the calculation for obtaining the vertical velocity component Vcy_bm in the direction perpendicular to the surface of the target landform U from the estimated boom velocity Vc_bm.

Thereafter, the controller 26 determines whether or not the condition for the stop control is satisfied (step SA8 in FIG. 11). For example, the controller 26 determines whether or not the distance d between the tip 8*aa* (the fully-extended stroke end) of the breaker 8 and the target landform U is within a predetermined range.

If the condition for the stop control is not satisfied, the stop control is not performed (step SA9 in FIG. 11). On the other hand, if the condition for the stop control is satisfied, the stop control is performed (step SA10 in FIG. 11).

As illustrated in FIG. 8, in the stop control, the velocity limit acquisition unit of the stop control unit 54 outputs the acquired boom velocity limit Vc_bm_lmt to the work implement control unit 57. The work implement control unit 57 determines a cylinder velocity corresponding to the boom velocity limit Vc_bm_lmt, and outputs a command current (control signal) corresponding to the cylinder velocity to the pilot valve 27. Thereby, the work implement 2 including the movement amount of the spool is controlled.

When the tip 8*aa* (the fully-extended stroke end) is located above the target landform U, the closer the tip 8*aa* approaches the target landform U, the smaller the absolute value of the velocity limit vertical component Vcy_bm_lmt of the boom 6 will be, and consequently, the smaller the absolute value of the velocity component of the velocity limit of the boom 6 (velocity limit horizontal component) Vcx_bm_lmt in the direction parallel to the surface of the target landform U will be. Therefore, when the tip 8*aa* (the fully-extended stroke end) is located above the target landform U, as the tip 8*aa* approaches closer to the target landform U, the velocity of the boom 6 in the direction perpendicular to the surface of the target landform U and the velocity of the boom 6 in the direction parallel to the surface of the target landform U are both reduced. As the distance d becomes equal to the predetermined value, the boom 6 is stopped.

<Flowchart of Automatic Stop Control of Striking by Breaker>

Next, an example flow of an automatic stop control of striking by the breaker according to the present embodiment will be described with reference to FIGS. 5, 11 and 12.

Figure 12:
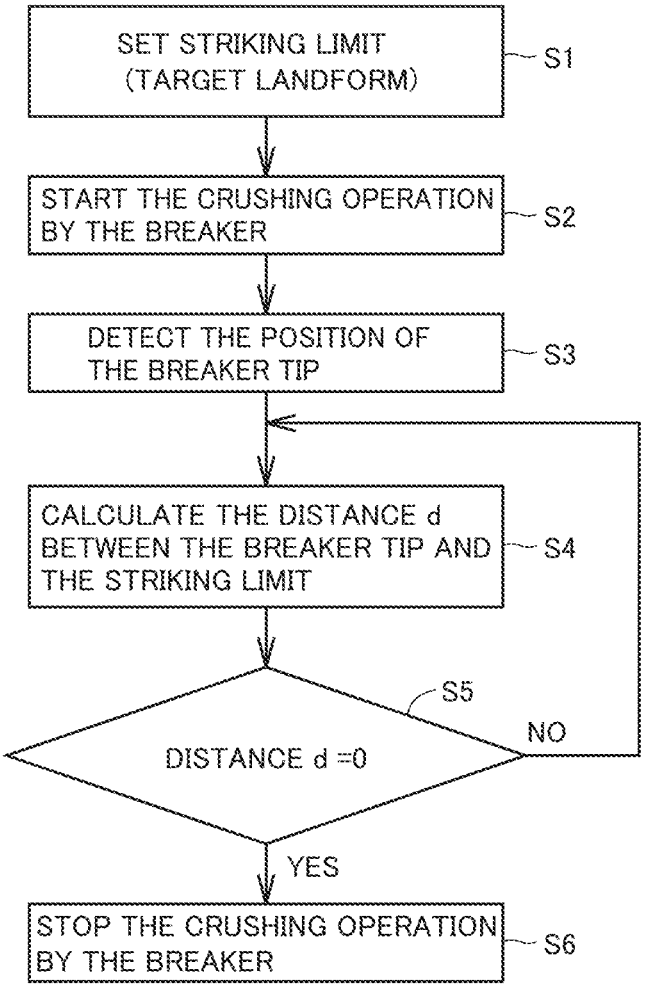
FIG. 12 is a flowchart illustrating an example of an automatic stop control of striking by the breaker according to an embodiment.

FIG. 12 is a flowchart illustrating an example of an automatic stop control of striking by the breaker according to an embodiment.

As illustrated in FIG. 12, a target landform (striking limit) is set (step S1 in FIG. 12). In the present embodiment, the target landform is set to the striking limit. Therefore, step S1 for setting the target landform (striking limit) is the same as step SA1 for setting the target landform U in FIG. 11.

However, the striking limit is not limited to the target landform U. Therefore, when the striking limit is set to a position different from the target landform U, step S1 for setting the striking limit is performed separately from step SA1 for setting the target landform U in FIG. 11.

As illustrated in FIG. 5, the striking limit, for example, may be input into the input control unit 45 by the operator through the input unit 321 or the display unit (monitor) 322 of the man-machine interface 32. Further, the striking limit may be input into the storage unit 46 before the work machine 100 is shipped. Furthermore, the striking limit, for example, may be input into the communication control unit 47 from the outside of the work machine 100 through the communication device 33.

Thereafter, the operator starts the crushing operation by using the breaker 8 (step S2 in FIG. 12). The operator starts the crushing operation when, for example, the tip 8*aa* of the breaker 8 is in contact with the surface of a land area to be crushed according to the above-described automatic control (stop control) as illustrated in FIG. 7. At this time, the fully-extended stroke end has not reached the target landform U. Thus, at this time, the automatic control (stop control) has not ended yet.

The crushing operation by the breaker 8 is started when the tip 8*aa* of the breaker 8 is actually pressed against the land area to be crushed and an appropriate thrust is applied to the breaker 8. The operator starts the crushing operation by operating the operation unit (the operation lever or pedal) 34. After the operator starts the crushing operation by the breaker 8, the breaker 8 starts to crush the land area. Specifically, as illustrated in FIG. 4, when the piston 8*c* of the breaker 8 strikes the tool 8*a*, a striking force is applied to the tool 8*a* so as to crush the land area.

When the crushing operation by the breaker 8 is started by the operator, the tip 8*aa* (the fully-extended stroke end) of the breaker 8 gradually approaches the target landform U. When the crushing operation by the breaker 8 is started by the operator, the controller 26 receives a signal for starting the crushing operation, and starts to detect the position of the tip 8*aa* (the fully-extended stroke end) of the breaker 8 (step S3 in FIG. 12). As illustrated in FIG. 5, the position of the tip 8*aa* (the fully-extended stroke end) is detected by the work implement attitude detection unit 41 of the controller 26 based on the information detected by the work implement attitude detection sensors 16 to 18. Similarly, in the automatic stop control of striking by the breaker 8, the position of the tip 8*aa* of the breaker 8 is also set to the position of the fully-extended stroke end of the tool 8*a* illustrated in FIG. 4 as in the automatic control (stop control) described above.

The distanced calculation unit 42 of the controller 26 calculates the distance d between the tip 8*aa* (the fully-extended stroke end) of the breaker 8 and the striking limit (step S4 in FIG. 12). The distance d calculation unit 42 calculates the distance d based on the position of the tip 8*aa* (the fully-extended stroke end) of the breaker 8 detected by the work implement attitude detection unit 41 and the position of the striking limit acquired from at least one of the input control unit 45, the storage unit 46 and the communication control unit 47. The method of calculating the distance d is the same as the method described in the automatic control (stop control).

The distance d determination unit 43 of the controller 26 determines whether or not the calculated distance d is equal to 0 (step S5 in FIG. 12). Specifically, the distance d determination unit 43 of the controller 26 determines whether or not the tip 8*aa* (the fully-extended stroke end) of the breaker 8 has reached the striking limit.

When the distance d determination unit 43 determines that the distance d is not equal to 0, the crushing operation by the breaker 8 and the calculation of the distance d by the distance d determination unit 43 are continued until the distance d becomes equal to 0.

On the other hand, when the distance d determination unit 43 determines that the distance d is equal to 0, the crushing operation by the breaker 8 is stopped (step S6 in FIG. 12). At the time when the crushing operation by the breaker 8 is stopped, the pilot valve control unit 44 sends an electrical control signal (EPC current) to the pilot valve 35 based on the determination result that the distance d determination unit 43 determines that the distance d is equal to 0. Thereby, the pilot valve 35 is controlled to stop the operation of the breaker 8.

The automatic control (stop control) is also stopped when the distance d determination unit 43 determines that the distance d is equal to 0.

Modified Example

Next, an automatic stop control of striking by the breaker according to a modified example will be described.

Figure 13:
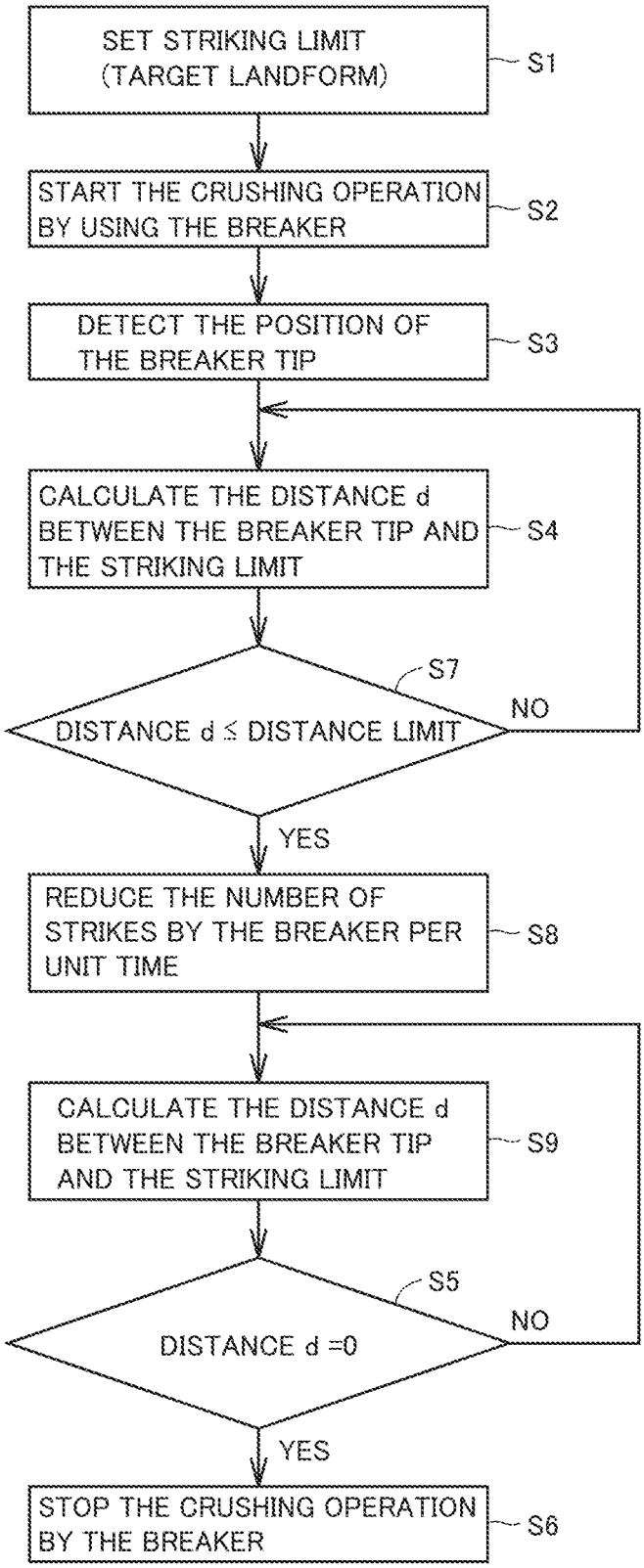
FIG. 13 is a flowchart illustrating a modified example of the automatic stop control of striking by the breaker according to an embodiment.
Figure 14:
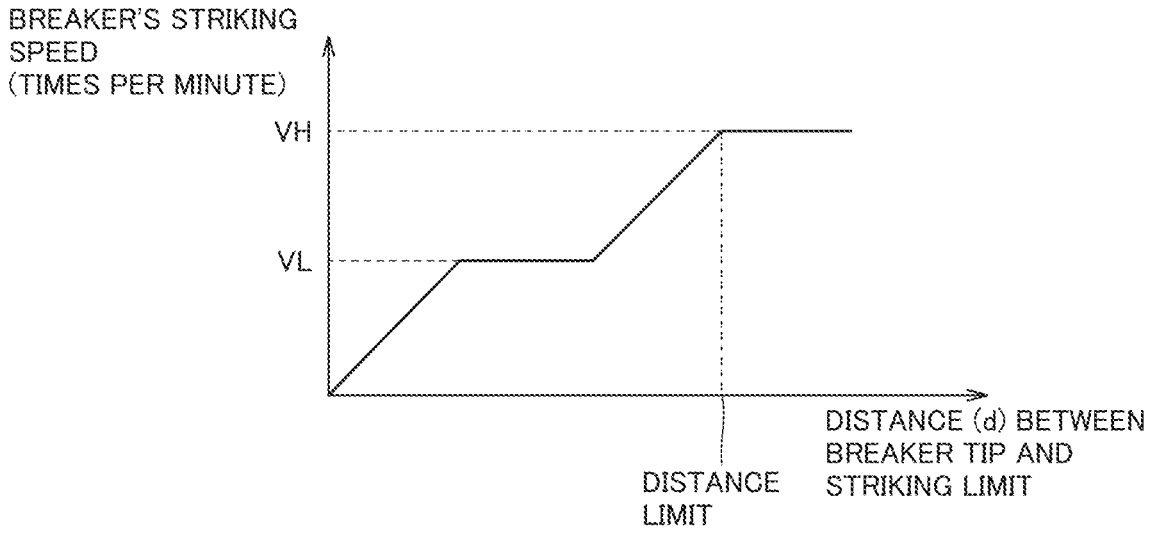
FIG. 14 is a diagram illustrating the relationship between the distance d and the striking speed of the breaker in the modified example of the automatic stop control of striking by the breaker.

FIG. 13 is a flowchart illustrating an automatic stop control of striking by the breaker according to a modified example. FIG. 14 is a diagram illustrating the relationship between the distance d and the striking speed of the breaker in the automatic stop control of striking by the breaker according to the modified example.

As illustrated in FIG. 13, the flowchart in the present modified example is mainly different from the flowchart illustrated in FIG. 12 in that step S7 for determining whether or not the distance d is equal to or less than the distance limit, and step S8 for reducing the number of strikes by the breaker 8 per unit time if the distance d is equal to or less than the distance limit are added.

In the flowchart of the present modified example, after step S4 for calculating the distance d, it is determined whether or not the distance d is equal to or less than the distance limit (step S7 in FIG. 13). This determination is performed by the distance d determination unit 43 of the controller 26 illustrated in FIG. 5. The distance d determination unit 43 determines whether or not the distance d acquired from the distance d calculation unit 42 is equal to or less than the distance limit.

Similar to the striking limit, the distance d determination unit 43 acquires the distance limit from at least one of the input control unit 45, the storage unit 46 and the communication control unit 47.

As illustrated in FIG. 7, the distance limit is a distance from the target landform U (striking limit) upward. When the tip 8*aa* of the breaker 8 contacts the surface of a land area to be crushed during the automatic control (stop control) as illustrated in FIG. 7, the distance limit is set to be located between the tip 8*aa* (the fully-extended stroke end) of the breaker 8 and the striking limits (the target landform U).

The distance limit, for example, may be input to the input control unit 45 by the operator through the input unit 321 or the display unit (monitor) 322 of the man-machine interface 32 as illustrated in FIG. 5. Further, the distance limit may be input to the storage unit 46 before the work machine 100 is shipped. Further, the distance limit may be input to the communication control unit 47 from the outside of the work machine 100 through the communication device 33, for example.

According to the determination result by the distance d determination unit 43, when it is determined that the distance d is greater than the distance limit, the distance d is calculated again (step S4 in FIG. 13).

On the other hand, according to the determination result by the distance d determination unit 43, when it is determined that the distance d is equal to or less than the distance limit, the number of strikes by the breaker 8 per unit time is reduced (step S8 in FIG. 13). When the distance d between the tip 8*aa* (the fully-extended stroke end) of the breaker 8 and the striking limit is equal to or less than the distance limit, the controller 26 (FIG. 6) controls the pilot valve 35 so that the number of strikes by the breaker 8 per unit time is less than that when the distance d is greater than the distance limit. The reduction in the number of strikes by the breaker 8 per unit time is performed by the pilot valve control unit 44 of the controller 26 illustrated in FIG. 5.

As illustrated in FIG. 14, the number of strikes by the breaker 8 per unit time is reduced by shifting from a state VH where the number of strikes per unit time is high to a state VL where the number of strikes per unit time is low.

Note that the striking speed of the breaker on the vertical axis in the graph of FIG. 14 indicates the number of strikes per unit time.

After the striking speed is reduced, the distance d is recalculated (step S9 in FIG. 13). Thereafter, similar to the flowchart illustrated in FIG. 12, it is determined whether or not the calculated distance d is equal to 0 (whether or not the tip 8*aa* (the fully-extended stroke end) of the breaker 8 has reached the striking limit) (step S5 in FIG. 13).

When the distance d determination unit 43 determines that the distance d is not equal to 0, the crushing operation and the calculation of the distance d by the distance d determination unit 43 are continued until the distance d becomes equal to 0.

On the other hand, when the distance d determination unit 43 determines that the distance d is equal to 0, the operation of the breaker 8 is stopped (step S6 in FIG. 13). When the operation of the breaker 8 is stopped, the pilot valve control unit 44 sends an electrical control signal (EPC current) to the pilot valve 35 based on the determination result that the distance d determination unit 43 determines that the distance d is equal to 0. Thereby, the pilot valve 35 is controlled to stop the operation of the breaker 8.

Other than those described above, the flowchart in the modified example is substantially the same as the flowchart illustrated in FIG. 12, the description thereof will not be repeated.

<Additional Notes>

In the embodiment and the modified example, the distance d is calculated in the automatic control (stop control) and the automatic stop control of striking by the breaker 8 by assuming the tip 8*aa* of the breaker 8 is located at the fully-extended stroke end as illustrated in FIG. 4. However, the distance d may be calculated in the automatic control (stop control) and the automatic stop control of striking by the breaker by assuming the tip 8*aa* of the breaker 8 is located at a position closer to the fully-contracted stroke end than the fully-extended stroke end.

For example, the distance d may be calculated in the automatic control (stop control) and the automatic stop control of striking by the breaker 8 by assuming that the tip 8*aa* of the breaker 8 is located at an arbitrary position between the fully-extended stroke end and the fully-contracted stroke end. Further, the distance d may be calculated in the automatic control (stop control) and the automatic stop control of striking by the breaker 8 by assuming that the tip 8*aa* of the breaker 8 is located at any position between the fully-extended stroke end and the half stroke position, for example.

In calculating the distance d, the tip 8*aa* of the breaker 8 may be located at different positions in the automatic control (stop control) and in the automatic stop control of striking by the breaker 8. For example, in the automatic control (stop control), the tip 8*aa* of the breaker 8 may be located at the fully-extended stroke end, and in the automatic stop control of striking by the breaker 8, the tip 8*aa* of the breaker 8 may be located at a position closer to the fully-contracted stroke end than the fully-extended stroke end.

<Effects>

In the embodiment and the modified example described above, as illustrated in FIG. 5, the controller 26 determines the distance between the tip 8*aa* of the breaker 8 and the striking limit from the attitude of the work implement 2 obtained from the work implement attitude detection sensors 16, 17 and 18, and controls the pilot valve 35 to stop the operation of the breaker 8 when it is determined that the tip 8*aa* has reached the striking limit. As a result, it is possible to prevent the breaker 8 from performing blank striking during the crushing operation. Thereby, it is possible to prevent the blank striking from being applied as a load to the breaker.

Further, in the embodiment and the modified example described above, as illustrated in FIG. 4, the distance d may be calculated in the automatic control (stop control) and the automatic stop control of striking by the breaker 8 by assuming that the tip 8*aa* of the breaker 8 is located at an arbitrary location between the half stroke position and the fully-extended stroke end. Thereby, it is possible to efficiently prevent the breaker 8 from performing blank striking during the crushing operation.

Moreover, in the embodiment and the modified example described above, the work implement attitude detection sensors 16, 17 and 18 illustrated in FIG. 5 are stroke sensors. Thereby, it is possible to detect the attitude of the work implement 2 from the stroke amounts of the work implement cylinders 10, 11 and 12.

Furthermore, the crushing operation by the breaker 8 is performed while the breaker 8 is being pressed against a land area to be crushed by the vehicle weight of the work machine 100. Thus, the tip 8*aa* of the breaker 8 may exceed the striking limit at the moment when the land area is crushed, which causes the blank striking or the collision of the main body 8*b* of the breaker 8 to occur.

In the modified example described above, as illustrated in FIGS. 13 and 14, when the distance d is equal to or less than the distance limit, the controller 26 (FIG. 5) controls the pilot valve 35 so that the number of strikes by the breaker 8 per unit time is less than that when the distance d is greater than the distance limit. Thereby, it is possible to prevent the tip 8*aa* of the breaker 8 from exceeding the striking limit at the moment when the land area is crushed, preventing the blank striking or the collision of the main body 8*b* of the breaker 8 from occurring.

It should be understood that the embodiments disclosed herein have been presented for the purpose of illustration and description but not limited in all aspects. It is intended that the scope of the present invention is not limited to the description above but defined by the scope of the claims and encompasses all modifications equivalent in meaning and scope to the claims.

REFERENCE SIGNS LIST

1: vehicle main body; 2: work implement; 3: revolving unit; 4: operator's cab; 4S: operator's seat; 5: traveling unit; 5Cr: crawler belt; 6: boom; 7: arm; 8: breaker; 8*a*: tool (chisel); 8*aa*: tip (first end); 8*ab*: second end; 8*b*: body; 8*c*: piston; 8*d*: control valve; 9: engine compartment; 10: boom cylinder; 11: arm cylinder; 12: breaker cylinder; 13: boom pin; 14: arm pin; 15: breaker pin; 16: boom cylinder stroke sensor; 17: arm cylinder stroke sensor; 18: breaker cylinder stroke sensor; 19: handrail; 20: position detector; 21: antenna; 21A: first antenna; 21B: second antenna; 23: global coordinate computation unit; 25: operation device; 25L: second operation lever; 25R: first operation lever; 26: controller; 27, 35: pilot valve; 28: display controller; 28A: construction target information storage unit; 28B: breaker position data generation unit; 28C: target landform data generation unit; 29, 322: display unit; 30: sensor controller; 32: man-machine interface; 33: communication device; 34: operation unit; 36, 64: direction control valve; 37: main pump; 38*a*, 38*b*: stop valve; 39: accumulator; 41: work implement attitude detection unit; 42: calculation unit; 43: determination unit; 44: pilot valve control unit; 45: input control unit; 47: communication control unit; 52: estimated velocity determination unit; 53: distance acquisition unit; 54: stop control unit; 46, 54*a*, 58: storage unit; 57: work implement control unit; 60: hydraulic cylinder; 66, 67: pressure sensor; 71, 73: filter; 72: oil cooler; 75: oil tank; 100: work machine; 200: control system; 300: hydraulic system; 321: input unit; 450: pilot oil passage; AX: revolution axis; U: target landform; d: distance

The invention claimed is:

1. A work machine comprising:

a work implement that includes a breaker;

a sensor that detects an attitude of the work implement;

a control valve that controls the operation of the breaker; and a controller that controls the control valve, the controller detecting a distance between a tip of the breaker and a striking limit from the attitude of the work implement obtained by the sensor, and controlling the control valve to stop the operation of the breaker when it is determined that the tip of the breaker has reached the striking limit.

2. The work machine according to claim 1, wherein the breaker includes a main body and a tool movably attached to the main body, the tip of the tool is movable between a fully-extended stroke end and a fully-contracted stroke end, and the controller detects the distance between the tip of the breaker and the striking limit by assuming that the tip of the breaker is located at an arbitrary location between a half stroke position and the fully-extended stroke end, the half stroke position being defined as such a position that is located in the middle of the fully-extended stroke end and the fully-contracted stroke end.

3. The work machine according to claim 2, wherein the work implement includes a work implement cylinder, and the sensor is a stroke sensor provided in the work implement cylinder.

4. The work machine according to claim 3, wherein the controller controls the control valve so that the number of strikes by the breaker per unit time when the distance between the tip of the breaker and the striking limit is less than or equal to a distance limit is less than that when the distance is greater than the distance limit.

5. The work machine according to claim 2, wherein the controller controls the control valve so that the number of strikes by the breaker per unit time when the distance between the tip of the breaker and the striking limit is less than or equal to a distance limit is less than that when the distance is greater than the distance limit.

6. The work machine according to claim 1, wherein the work implement includes a work implement cylinder, and the sensor is a stroke sensor provided in the work implement cylinder.

7. The work machine according to claim 6, wherein the controller controls the control valve so that the number of strikes by the breaker per unit time when the distance between the tip of the breaker and the striking limit is less than or equal to a distance limit is less than that when the distance is greater than the distance limit.

8. The work machine according to claim 1, wherein the controller controls the control valve so that the number of strikes by the breaker per unit time when the distance between the tip of the breaker and the striking limit is less than or equal to a distance limit is less than that when the distance is greater than the distance limit.

9. A method for controlling a work machine including a work implement that includes a breaker and a control valve that controls the operation of the breaker, the method comprising:

detecting a distance between a tip of the breaker and a striking limit from an attitude of the work implement; and controlling the control valve to stop the operation of the breaker when it is determined that the tip of the breaker has reached the striking limit.

10. The method for controlling a work machine according to claim 9, further comprising:

controlling the control valve so that the number of strikes by the breaker per unit time when the distance between the tip of the breaker and the striking limit is less than or equal to a distance limit is less than that when the distance is greater than the distance limit.

* * * * *